US006834826B2

(12) United States Patent
Nobuta et al.

(10) Patent No.: US 6,834,826 B2
(45) Date of Patent: Dec. 28, 2004

(54) FILM CONNECTING/FEEDING APPARATUS

(75) Inventors: Kiyoshi Nobuta, Nagareyama (JP); Tuyoshi Okabe, Nagareyama (JP); Tomoo Hosono, Nagareyama (JP); Ryosuke Tamayama, Nagareyama (JP)

(73) Assignee: Tokyo Automatic Machinery Works, Ltd., Tokyo (JP)

( * ) Notice: Subject to any disclaimer, the term of this patent is extended or adjusted under 35 U.S.C. 154(b) by 116 days.

(21) Appl. No.: 10/121,104

(22) Filed: Apr. 11, 2002

(65) Prior Publication Data

US 2002/0148924 A1 Oct. 17, 2002

(30) Foreign Application Priority Data

Apr. 12, 2001 (JP) ..... 2001-113901

(51) Int. Cl.[7] ..... B65H 19/18

(52) U.S. Cl. ..... 242/555.3; 242/559; 242/560.1

(58) Field of Search ..... 242/555, 555.1, 242/555.3, 555.4, 555.6, 556, 551, 554, 560, 561, 563, 558, 559, 560.1, 554.1, 559.1, 559.3, 563.1

(56) References Cited

U.S. PATENT DOCUMENTS

| | | | | | |
|---|---|---|---|---|---|
| 794,578 | A | * | 7/1905 | Wood | 242/555.2 |
| 2,005,037 | A | * | 6/1935 | Johancen et al. | 242/555.3 |
| 2,389,443 | A | * | 11/1945 | Lyle | 242/559.1 |
| 2,745,464 | A | * | 5/1956 | Auerbacher et al. | 242/555.1 |
| 3,176,928 | A | * | 4/1965 | Saunders | 242/559 |
| 3,197,017 | A | * | 7/1965 | Ungerer | 242/559 |
| 4,173,314 | A | * | 11/1979 | Curran et al. | 242/555.3 |
| 4,386,741 | A | * | 6/1983 | Weiss et al. | 242/559.3 |
| 4,564,150 | A | * | 1/1986 | Keene et al. | 242/555.3 |
| 4,729,519 | A | * | 3/1988 | Tafel et al. | 242/555.3 |
| 4,934,621 | A | * | 6/1990 | Jacobs | 242/555.3 |

FOREIGN PATENT DOCUMENTS

| | | |
|---|---|---|
| JP | 58-074445 | 5/1983 |
| JP | 01-261150 | 10/1989 |
| JP | 04-338056 | 11/1992 |
| JP | 05-97122 | 4/1993 |
| JP | 05-112326 | 5/1993 |
| JP | 6-278921 | 10/1994 |

* cited by examiner

*Primary Examiner*—William A. Rivera
(74) *Attorney, Agent, or Firm*—Jordan and Hamburg LLP

(57) ABSTRACT

Film rolls at the delivery position and the standby position are supported by supporting units. The roll is passed from the standby position to the delivery position by means of the conveying member provided in the roll conveying unit. As a result, it is not necessary to support the rolls at the individual positions by use of the roll conveying unit, thus permitting simplification of the configuration of the unit. The conveying member has a configuration in which the same is attached to a conveying chain put around the sprockets to make it possible to achieve circumferential travel of the conveying member by a single driving motor. When delivering by connecting to the film from the delivery position, the leading end easily comes off the holding unit by inserting the folded leading end of the film from the standby position and holding the same there.

19 Claims, 18 Drawing Sheets

22
22b
30
S
L
12a
a
90
30
ΔP
S
6
6
11
d
X
12
104
6
6
β
X+L−y
Nd
y
12

FILM CONNECTING/FEEDING APPARATUS

BACKGROUND OF THE INVENTION

1. Field of the Invention

The present invention relates to a film connecting/feeding apparatus to be incorporated into a wrapping system. More particularly, the invention relates to a film connecting/feeding apparatus which makes it possible to continuously feed a film by connecting a trailing end of a film delivered from a film roll and a leading end of a spare film roll.

2. Description of the Related Art

Conventionally known film connecting/feeding apparatuses of this type include those disclosed in Japanese Unexamined Patent Application Publications Nos. 4-338056, 6-278921, 5-97122, and 5-112326.

Among others, Japanese Unexamined Patent Application Publications Nos. 4-338056 and 6-278921 disclose conventional apparatus having features in a conveying unit of the film roll.

As shown in FIG. 17, the web feeding apparatus 200 (film connecting/feeding apparatus) in 4-338056 comprises a rewinding position 202, a standby position 204 and a feeding position 205, and has a configuration in which the trailing end of a web 201*a* delivered from a web roll 201 held at the rewinding position 202 and the leading end of a web 203*a* delivered from a spare web roll 203 held at the standby position 204 are connected at the connecting position 205.

The web feeding apparatus 200 has an annular driving belt 206 travelling around between the rewinding position 202 and the standby position 204, and three bearings 207 are attached to the annular driving belt 206 at equal intervals. These bearings 207 can rotatably support web rolls, respectively.

When one 207 of these bearings 207 is moved to the rewinding position 202 and arranged there, another bearing 207 is moved to the standby position 204 and arranged there. The remaining bearing 207 is in standby at the middle among the positions.

As shown in FIG. 18, the web connecting/feeding apparatus 300 disclosed in Japanese Unexamined Patent Application Publication No. 6-278921 has swinging levers 304 and 305. One 304 of the levers rotatably holds a spare web roll 303*a* at the tip thereof, and the other lever 305 rotatably holds a delivery web roll 303*b*. The levers 304 and 305 are driven by driving mechanisms 306 and 307, respectively.

When all the web is delivered from the delivery web roll 303*b*, the lever 305 swings counterclockwise in FIG. 18, and excludes the roll core remaining at the tip of the lever 305. Subsequently, the levers 304 and 305 oscillate in synchronization, and the web roll 303*a* held at the tip of the lever 304 is passed to the tip of the lever 305.

Japanese Unexamined Patent Application Publications Nos. 5-971122 and 5-112326 disclose conventional apparatuses characterized by spare film leading end holding means at a connecting position.

The automatic connecting apparatus of a wrapping film disclosed in 5-97122 has a configuration in which the leading end of a film is held by vacuum sucking to bring the same into standby at the connecting position.

The paper connecting apparatus disclosed in 5-112326 has a configuration in which the leading end of a web is held by means of an adhesive tape to bring the same into standby at the connecting position.

As described above, the web feeding apparatus disclosed in Japanese Unexamined Patent Application Publication No. 4-338056 has a configuration in which the bearing 207 is provided directly on the annular driving belt 206 travelling around between the rewinding position 202 and the standby position 204, and the web rolls 201 and 203 are held at the individual positions 202 and 204 by means of this bearing 207. The bearing 207 rotatably supporting the web rolls should have a strong structure capable of withstanding the load and rotating force of the web rolls.

A plurality of such bearings 207 having a strong structure as described above are necessary. In addition, in order to support these bearings 207 by an annular driving belt 206 such as a chain or a belt, it is necessary to impart a strength sufficient to resist to the action of a considerable load to the annular driving belt 206. Comprehensive satisfaction of these requirements poses a problem of a very high manufacturing cost.

Also in the web connecting/feeding apparatus 300 disclosed in 6-278921, provision of driving sections 306 and 307 for the levers 304 and 305 holding the web roll leads to troublesome control and poses the problem of a high manufacturing cost of the apparatus.

In the apparatus disclosed in 5-97122 and 5-112326, the film (web) leading end is held at the connecting position by an adhesive tape or vacuum sucking. These holding means use a large holding force in general acting on the film. This may cause a positional shift of the film from the delivery track when stripping off the film from the connecting position after connection of the film, thus impairing stable continuous delivery of the film.

SUMMARY OF THE INVENTION

The present invention was developed in view of these circumstances, and has an object to ensure stable continuous delivery of the film with a low manufacturing cost.

To achieve the above-mentioned object, the film connecting/feeding apparatus has a configuration in which there are set a delivery position where a delivery film roll is held; a standby position where a spare film roll is held; and a connecting position where a leading end of a film delivered from the spare film roll is held, and the leading end and a film delivered from the delivery position are connected; the apparatus comprising delivery supporting means, provided at the delivery position, which rotatably supports the axial core of a delivery film roll, and standby supporting means, provided at the standby position, which supports the axial core of the spare film roll; and an endless belt member which is put around a rotary member and circumferentially travels, and roll conveying means which comprises a conveying member which is attached to this endless belt member, and holds the axial core of the film roll; wherein the roll conveying means receives a spare film roll by means of the conveying member from the standby supporting means, conveys the film roll to the delivery position, and passes the same to the delivery supporting means.

According to the present invention in which there are provided delivery supporting means and standby supporting means which support the film roll, respectively, at the delivery position and the standby position, the necessity is eliminated to impart a function for supporting the film roll to the roll conveying means accounting for a particularly large ratio among items of parts cost of the apparatus. It is therefore possible to achieve a simpler configuration of the roll conveying means and thus to reduce the manufacturing cost for the apparatus as a whole.

Since the roll conveying means has a configuration in which the endless belt means is wound around the rotary members and the conveying member is attached to this endless belt member, it is possible to cause a circumferential movement of the conveying member by the rotational driving force by rotating the rotary member with a single driving source. It is not therefore necessary to provide a plurality of driving sources, thus permitting reduction of the number of driving sources, leading to a lower cost of the apparatus.

The film connecting/feeding apparatus of the invention may further comprise a discharge path for discharging the axial core having delivered the film; wherein the conveying member of the roll conveying means further receives an axial core having delivered the film, remaining at the delivery position from the delivery supporting means, and conveys the same to the discharge path.

According to this configuration, an axial core of which the film has been delivered to the delivery position never remains, and it is thus possible to pass a film roll without any trouble to the delivery supporting means by the conveying member.

The apparatus of the invention may have a configuration in which an operating board is attached to the apparatus main body so as to be opened and closed; a holding member which holds an inserted folded portion formed by folding the leading end of the film delivered from the standby position, with a side of the operating board as an operating surface is attached to the operating surface; and in the closed state of the operating board, the holding member is positioned at the connecting position.

According to this configuration, the holding member holding the leading end of the film delivered from the standby position can be positioned at the connecting position in the closed state of the operating board. It is therefore possible to accurately position the leading end of the film and stably accomplish connection with the film delivered from the delivery position.

Because the folded portion formed by folding the leading end of the film is held by inserting the same into the holding member, it is possible to prevent occurrence of a positional shift of the film as a result of easy trip of the leading end of the film from the holding member upon delivery after film connection.

The apparatus of the invention may have a configuration in which an operating position for carrying out an operation of folding the leading end of the film delivered from the standby position and causing the holding member to hold the folded position is set on the front side of the apparatus main body; and the operating board is arranged so that, in the opened state, the operating surface is placed upward at the operating position.

According to this configuration, it is possible to cause the holding member to easily hold the leading end of the film at the operating position, and improve operability thereof.

The apparatus of the invention may have a configuration in which an edge positioning section which guides edges on both sides of the film delivered from the standby position is formed on the operating surface of the operating board.

According to this configuration, it is possible to easily accomplish positioning of both edges of the film.

The apparatus of the invention may have an operating board made of a transparent material. By adopting this configuration, even when the operating board is closed, it is possible to easily confirm the internal state of the apparatus, thus permitting easier maintenance control.

The apparatus of the invention may have a configuration in which a feeding position at which the film roll is fed to the standby position, a discharge position set at the terminal end of the discharge path, and the operating position are arranged in the height direction on the front side of the apparatus main body.

In this configuration, the operation of feeding the film roll, the operation of holding the leading end of the film by the holding member, and the operation of removing the axial core after delivery of the film can be conducted on the front side of the apparatus main body, thus permitting remarkable improvement of operating efficiency.

The apparatus of the invention may have a configuration in which the apparatus comprises end detecting means which detects the end of the film delivered from the delivery position at a prescribed detecting position; and connecting position aligning means which delivers the end portion of the film of which the end has been detected by the end detecting means to the connecting position in response to the distance between the detecting position and the connecting position.

By adopting such a configuration, it is possible to achieve a wrapping loss under a pitch of wrapping bag during connection with the spare film, thus permitting minimization of wrapping loss.

The apparatus of the invention may have a configuration in which the apparatus comprises registration mark detecting means which detects a registration mark attached to the film delivered from the delivery position at a prescribed position; wrapping length storing means which stores a wrapping length set on the film delivered from the delivery position; and registration mark aligning means which aligns a registration mark position of a film of which the end has been detected by the end detecting means and of which the registration mark has been detected by the registration mark detecting means with the registration mark position of a film of which the leading end portion has been held at the connecting position, on the basis of a wrapping length stored in the wrapping length storing means and the distance between the registration mark detecting position and the connecting position.

According to this configuration, for various films of different wrapping lengths, it is possible to carry out pattern alignment automatically simultaneously with connection of films with reference to registration mark, thus improving operability.

DESCRIPTION OF THE PREFERRED EMBODIMENTS

Optimum embodiments of the present invention will now be described with reference to the drawings.

[Overall Configuration of Wrapping Unit and Film Connecting/Feeding Apparatus]

First, the overall configurations of a wrapping system to which the film connecting/feeding apparatus of the invention is applicable, and the film connecting/feeding apparatus of the invention will now be described.

Figure 1:
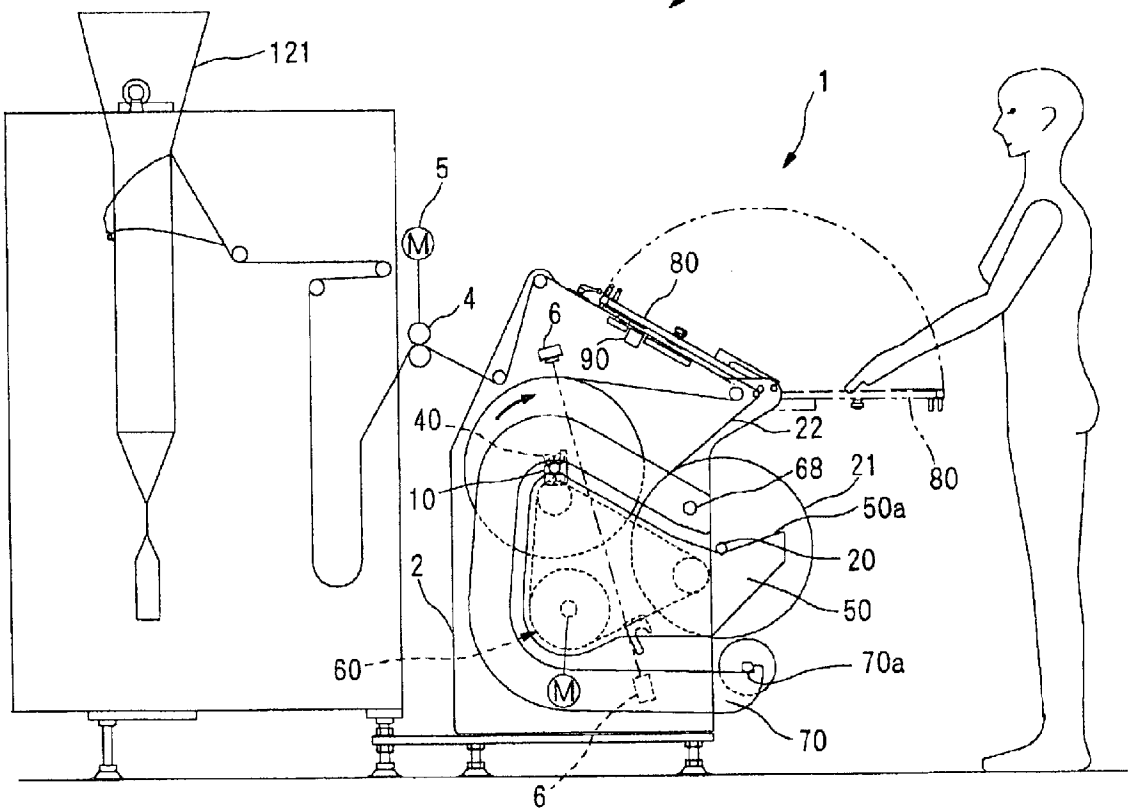
FIG. 1 is a side view illustrating an overall configuration of a wrapping system into which the film connecting/feeding apparatus of the present invention is incorporated.
Figure 2B:
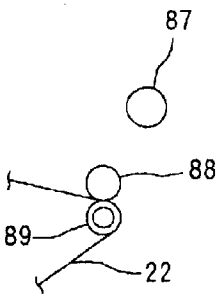
FIG. 2B is an enlarged view of the opening/closing center axis and the inserting/guiding portion of a film based on a film guiding pin and a coil spring of the film connecting/feeding apparatus of the invention.
Figure 2A:
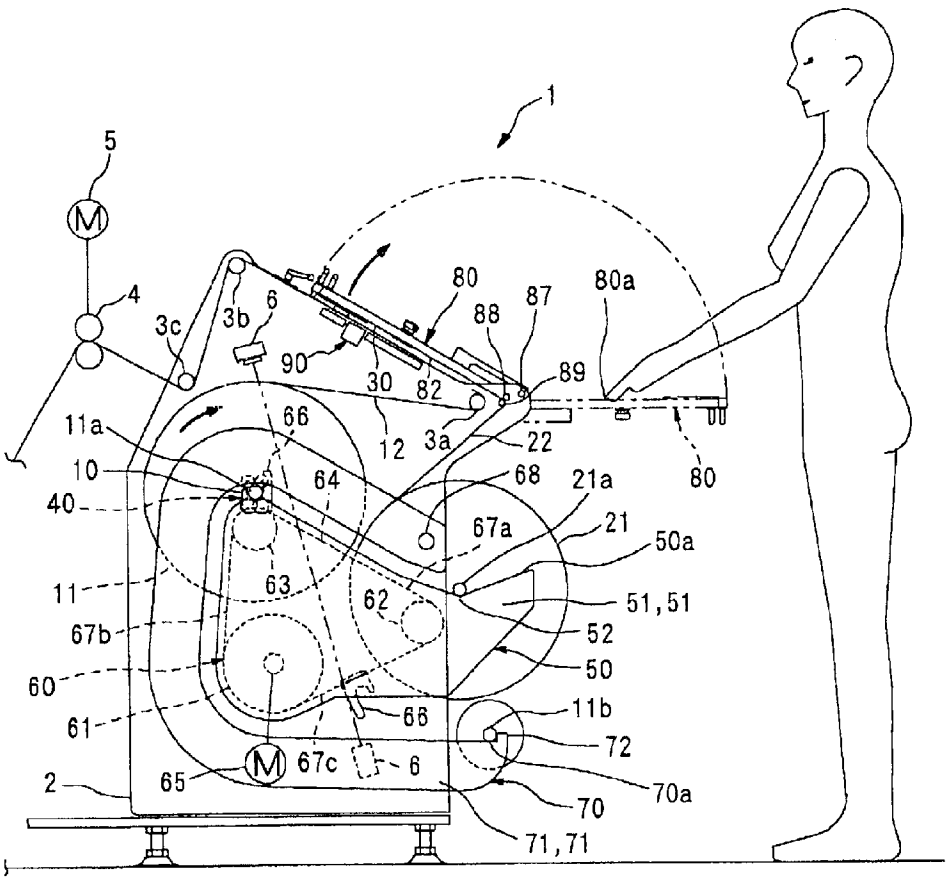
FIG. 2A is a side view illustrating an overall configuration of the film connecting/feeding apparatus of the invention.

As shown in FIGS. 1 and 2A, the film connecting/feeding apparatus 1 is incorporated into the upstream side (right side in FIG. 1) of a wrapping system 120. A delivery position 10, a standby position 20, and a connecting position 30 are set in the interior of the apparatus main body 2 of this film connecting/feeding apparatus 1.

A delivery supporting unit 40 is provided at the delivery position 10, and this delivery supporting unit 40 supports a delivery film roll 11.

A film 12 delivered from the film roll 11 supported at the delivery position 10 is delivered while being guided by guiding rollers 3*a* to 3*c*. Delivery is conducted by a delivery roller 4. The delivered film 12 is supplied to an upright bag-making/filling wrapping machine 121 arranged in the downstream (left side in FIG. 1) of the wrapping system 120. The delivery roller 4 is rotation-driven by a delivery motor 5, and the film 12 is delivered by the rotation driving force of this delivery motor 5.

A standby supporting unit 50 is provided at the standby position 20. A spare film roll 21 is supported by the standby supporting unit 50. This standby supporting unit 50 is provided continuously up to the feeding position 50*a* of the spare film roll 21 formed on the front side of the standby supporting unit 50.

A roll conveying unit 60 is provided in the apparatus main body 2. The roll conveying unit 60 receives the spare film roll 21 from the standby position 20 and can pass the film roll 21 to the delivery position 10.

The roll conveying unit 60 receives an axial core 11*b* having delivered the film remaining at the delivery position 10 and pass the axial core 11*b* to a discharge unit 70 arranged at the bottom of the apparatus main body 2 to permit discharge thereof.

The terminal end portion of the discharge unit 70 extends to the bottom of the front of the apparatus main body 2. The terminal end portion is set at a discharge position 70*a* of the axial core 11*b* after film delivery.

A holding unit 80 is provided at the top opening of the apparatus main body 2 so as to be opened and closed. In the closed state of the top opening of the apparatus main body 2, the holding unit 80 is in contact with the connecting position 30. The holding unit 80 can hold the leading end portion 22*a* of the film 22 delivered from the spare film roll 21 at this connecting position 30.

In the opened state of the top opening of the apparatus main body 2, the holding unit 80 is in contact with an operating position 80*a* set on the top of the front of the apparatus main body 2. At this operating position 80*a*, the holding unit 80 holds the leading end portion of the film 22 delivered from the spare film roll 21.

A connecting unit 90 is provided below the holding unit 80. When all the film 12 is delivered from the delivery position 10, the connecting unit 90 has a function of heat-sealing the terminal end portion of the film 12 and the leading end portion 22*a* of the film 22 delivered from the standby position 20 at the connecting position 30.

A terminal end position sensor 6 is provided in the apparatus main body 2, and the terminal end position of the film 12 delivered from the delivery position 10 can be detected by the sensor 6.

[Film Roll Supporting Unit, Roll Conveying Unit, and Discharge Unit]

Figure 3:
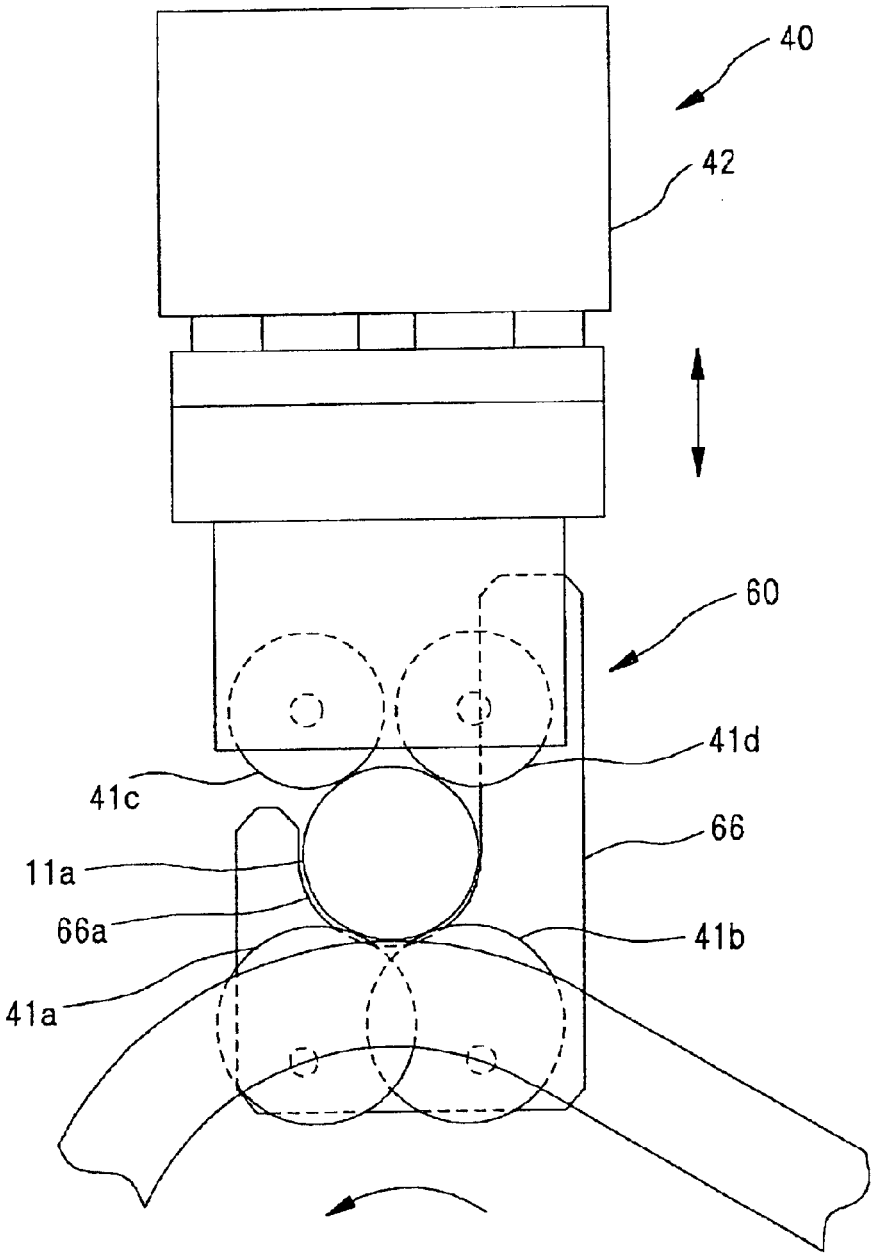
FIG. 3 is an enlarged side view of the configuration of the delivery supporting unit in the film connecting/feeding apparatus of the invention.

The film roll supporting unit, the roll conveying unit and the discharge unit will now be described with reference to FIGS. 2A, 2B and 3.

The delivery supporting unit 40 has each two bearings 41*a* to 41*d* at upper and lower portions with the delivery position 10 in between, and these bearings 41*a* to 41*d* rotatably support the axial core 11*a* of the delivery film roll 11. Therefore, when the film 12 is delivered from the film roll 11 and the axial core 11*a* rotates, the bearings 41*a* to 41*d* are rotated accordingly. As a result, it is possible to prevent mutual wear of the axial core 11*a* and the bearings 41*a* to 41*d*.

From among these bearings 41*a* to 41*d*, the lower bearings 41*a* and 41*b* are fixed at the installation positions to the apparatus main body 2. The upper bearings 41*c* and 41*d* are attached, on the other hand, to an air cylinder 42, and are vertically movable under action of this air cylinder 42.

In this configuration, when the air cylinder 42 is driven, the upper bearings 41*c* and 41*d* move downward, and the axial core 11*a* of the delivery film roll 11 is held between the lower bearings 41*a* and 41*b*. The axial core 11*a* is therefore stably supported without a play.

On the other hand, when the upper bearings 41*c* and 41*d* are moved upward by driving the air cylinder 42, it is possible to separate these bearings 41*c* and 41*d* from the lower bearings 41*a* and 41*b*. As a result, it is possible to easily cause the axial core 11*a* of the delivery film roll 11 to come off these bearings 41*a* to 41*d*.

The standby supporting unit 50 has a pair of feeding rails 51 on both sides thereof. The feeding rail 51 extends to the front side of the apparatus main body 2. The trailing end thereof is arranged at the standby position 20, and the front end thereof is arranged at a feeding position 50*a*.

The feeding position 50*a* should preferably be set at a height allowing supply of the film roll 21 without operator's bending down.

The feeding rail 51 is formed in downward inclination from the front end toward the trailing end. A cavity 52 is formed by bending upward the trailing end. Therefore, when the film roll 21 is fed from the feeding position 50*a*, the axial core 21*a* moves under gravity to the trailing end while rolling on the feeding rails 51. The axial core 21*a* of the film roll 21 having moved to the trailing end of the feeding rail 51 enters the cavity 52 and is held there.

In this embodiment, the film rolls 11 and 21 supported by the above-mentioned supporting unit 40 and the standby supporting unit 50 have a diameter of about 400 mm.

The roll conveying unit 60 has an endless conveying chain 64 (endless belt member) put around a driving-side sprocket 61 (driving-side rotary member) and two follower-side sprockets 62 and 63 (follower-side rotary members).

Two conveying member 66 and 66 are attached at an interval of 180E to the conveying chain 64. The conveying member 66 is formed into approximately J shape so as to enable the cavity 66*a* to hold the axial cores 11*a* and 21*a* of the film rolls 11 and 21.

A driving motor 65 is attached to the rotation shaft of the driving-side sprocket 61. By the driving force of this driving motor, the driving-side sprocket 61 is rotation-driven counterclockwise in the drawing. The driving force of the driving motor 65 is transmitted to the follower-side sprockets 62 and 63 via the conveying chain 64 to rotate the follower-side sprockets 62 and 63. This makes it possible for the conveying chain 64 to circumferentially rotate counterclockwise in the drawing.

The track of the conveying chain 64, i.e., the circumferential movement path of the conveying members 66 and 66 includes a film replacing path 67*a*, a conveying path 67*b* of the axial core 11*b* after film delivery, and a return path 67*c* of the conveying members 66 and 66. Among others, the film replacing path 67*a* connects the delivery position 10 and the standby position 20. The path 67*b* for conveying the axial core 11*b* after film delivery connects the delivery position 10 and the starting end of the discharge unit 70. The return path 67*c* of the conveying members 66 and 66 connects the starting end of the discharge unit 70 and the standby position 20. These paths 67*a*, 67*b* and 67*c* are formed along the individual sides of a virtual triangle.

Therefore, after delivery of the film 12 from the delivery position 10, the conveying members 66 receive the remaining core 11*b* after film delivery from the supporting unit 40 by causing circumferential travel of the conveying member 66. The conveying member 66 conveys the received axial core downward while holding the same in the cavity 66*a*. This permits passage and discharge of the axial core 11*b* to the discharge unit 70.

The conveying member 66 receives the spare film roll 21 from the standby supporting unit 50, and conveys the axial core 21*a* thereof, while holding the same in the cavity 66*a*, to the delivery position 10. As a result, the spare film roll 21 is passed to the delivery supporting unit 40, and replacing operation of the film rolls 11 and 21 is automatically executed.

After passing the spare film roll 21 to the delivery supporting unit 40, the conveying members 66 are held in standby at the delivery position 10.

The cavity 66*a* of the conveying member 66, upon circumferential travel of the conveying member 66, is set so that the travel track thereof interferes with the lower bearings 41*a* and 41*b* provided on the delivery supporting unit 40. Therefore, the film roll 21 is passed to the delivery supporting unit 40 so that the axial core 21*a* rides over bearings 41*a* and 41*b*.

In the state in which the conveying member 66 is in standby on the delivery supporting unit 40, a gap is formed between the cavity 66*a* and the axial core 11*a* of the delivery film roll 11, thus avoiding mutual contact. Therefore, even when the axial core 11*a* rotates upon film delivery, the axial core 11*a* and the cavity 66*a* never mutually wear.

The individual travel paths 67*a* to 67*c* of the conveying member 66 are set so as to have a short distance between them by bringing the individual sprockets 61 to 63 closer to each other, or bringing the delivery position 10 closer to the standby position 20. This reduces the size of the film connecting/feeding apparatus 1. For example, for the film replacing path 67*a*, a distance of about 410 mm is set. When the film rolls 11 and 21 having a diameter of 400 mm are held at the delivery position 10 and the standby position 20, as described above, the interval between the film rolls 11 and 21 would be about 10 mm.

A maintenance request button 68 is provided on the apparatus main body 2. By continuously pressing this maintenance request button 68, it is possible to cause rotation of the driving motor 65 clockwise to achieve circumferential travel of the conveying member 66 in the same direction. As a result, at an emergency or during maintenance, it is possible to easily collect the same from the front side by conveying the delivery film roll 11 from the delivery position 10 to the standby position 20.

Two conveying members 66 are attached to the conveying chain 64 in this embodiment, but only a single conveying member 66 may be attached.

The discharge unit 70 has a pair of discharge rails (discharge paths) 71 on both sides. The discharge rails 71 extend to the front side of the apparatus main body 2, and the terminal end thereof is arranged at the discharge position 70*a*. The discharge position 70*a* is set at a height allowing the operator to take out the axial core 116 by only slightly bending down.

The discharge rail 71 is formed with a slight downward inclination from the starting end toward the terminal end. When the axial core 11*b* after film delivery is passed from the roll conveying unit 60 to the discharge rail 71, therefore, the axial core 11*b* moves under gravity while rolling on the discharge rail 71, and is discharged to the discharge position 70*a* at the terminal end.

Projections 72 are provided on the terminal end portions of these discharge rails 71 and 71 so that the discharged axial core 11*b* is certainly held at the discharge position 70*a*.

[Configuration of Holding Unit and Connecting Unit]

The configuration of the holding unit 80 and the connecting unit 90 will now be described with reference to FIGS. 4 to 6.

The holding unit 80 has an operating board 81 attached to the top of the apparatus main body 2 so as to be opened and closed. In the closed state, the inner surface of the operating board 81 (hereinafter referred to as "operating surface 82") is arranged at the aforementioned connecting position 30.

The operating board 81 is made mainly of a transparent material such as an acryl plate. At the connecting position 30, the delivery film 12 and the spare film 22 are heat-sealed. The portion of the operating board 81 corresponding to the connecting position 30 is made of a heat-resistant material such as a Teflon sheet or silicone rubber.

A holding member 83 is provided on the portion corresponding to the connecting position 30 of the operating surface 82 of the operating board 81. The holding member 83 has a function of holding the leading end 22*a* of the film 22 delivered from the standby position 30 at the connecting position 30.

The holding member 83 has a pressing plate 83*b* extending from the lower end of the base 83*a* along the operating surface 82. The pressing plate 83*b* has a free leading end. The pressing plate 83*b* is therefore flexible around the base.

The pressing plate 83*b* is formed with an upward inclination from the base toward the leading end which is bent downward. An opening 83*c* formed between the leading end and the operating surface 82 of the operating board 81 serves as an insertion port into which the leading end 22*a* of the film 22 can be inserted.

A pair of side end positioning members 84 and 84 are arranged at two places in the delivery direction of the film 22 on the operating surface 82 of the operating board 81. These side end positioning members 84 are formed into a sheet shape, and guide the side edge of the film 22 along the inner ends thereof.

The side end positioning member 84 is connected to a supporting member 84*a*. The supporting member 84*a* is movable along a long groove 84*b* extending to sides of the operating board 81.

The side end positioning member 84 is therefore movable sideways and can flexibly cope with a change in position of both sides of the film 22 or a change in the width. The side end positioning member 84 and the supporting member 84*a* are coupled via a screw 84*c*. It is possible to hold the operating board 81 between the side end positioning member 84 and the head 84*d* of the supporting member 84*a* by tightening the screw 84*c* through rotation of the supporting member 84*a*. The side end positioning member 84 is thus secured.

The side end positioning member 84 provided to the left in front has a trailing end 84*e* positioned at a registration mark aligning position for aligning the position of a registration mark 22*b* affixed to the film 22.

A slit 85 extending sidewise is formed on the front side with a distance from the trailing end 84*e* of the side end positioning member 84. This slit 85 serves as a leading end aligning position for positioning the leading end 22*a* when holding the leading end 22*a* of the film 22.

A plurality of suction holes 86 are provided on the operating surface 82 of the operating board 81. These suction holes 86 communicate with a suction pump not shown through a vacuum chamber 86*a* provided in the operating board 81. It is therefore possible to apply suction force of the suction pump to the suction holes 86, and consequently, hold by suction the sheet surface of the film 22.

As shown in an enlarged view in FIG. 2B, a film guiding pin 88 and a coil spring 89 in pair are provided under an opening/closing center shaft of the operating board 81. In the closed state of the operating board 81, guiding from the film roll 21 to the operating surface 82 is accomplished by holding the film 22 between the film guiding pin 88 and the coil spring 89.

In the opened state, the operating board 81 is formed so that the operating surface 82 is directed upward, and the operating surface 82 is arranged at the operating position 80*a* set on the top of the front of the apparatus main body 2 (see FIG. 2A). The operating surface 82 arranged at the operating position 80*a* is set at a height permitting operation by the operator in an upright posture while looking down the object.

In the open state of the operating board 81, the operating surface 82 is set by aligning in the height direction with the feeding position 50*a* of the above-mentioned spare film roll and the discharge position 70*a* of the axial core 11*b* after film delivery. The operator can therefore carry out operations at the same place without moving.

The method for holding the leading end 22*a* of the film 22 delivered from the standby position 20 by means of the holding unit 80 will now be described.

Figure 4:
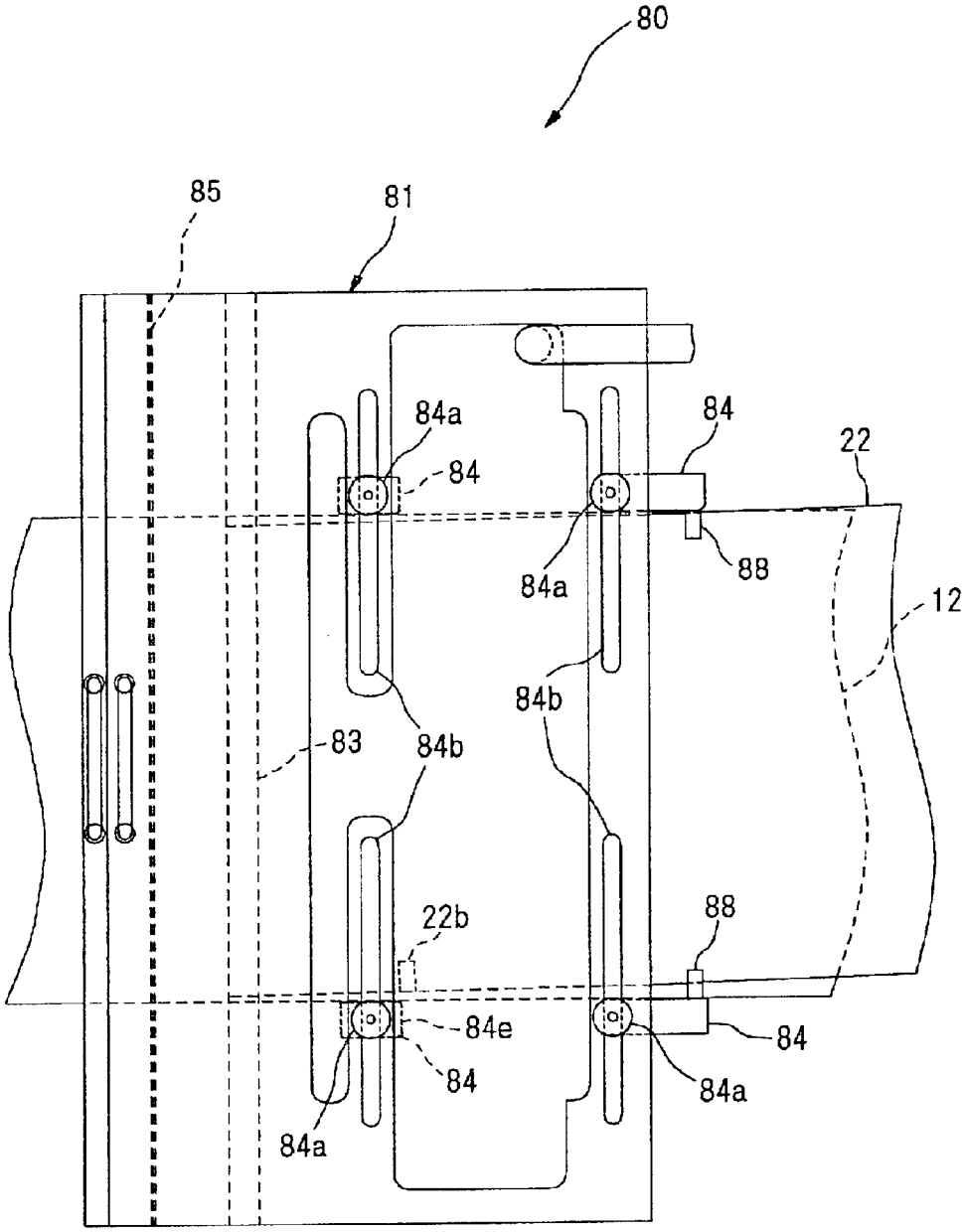
FIG. 4 is a plan view illustrating the configuration of the holding unit in the film connecting/feeding apparatus of the invention.
Figure 5:
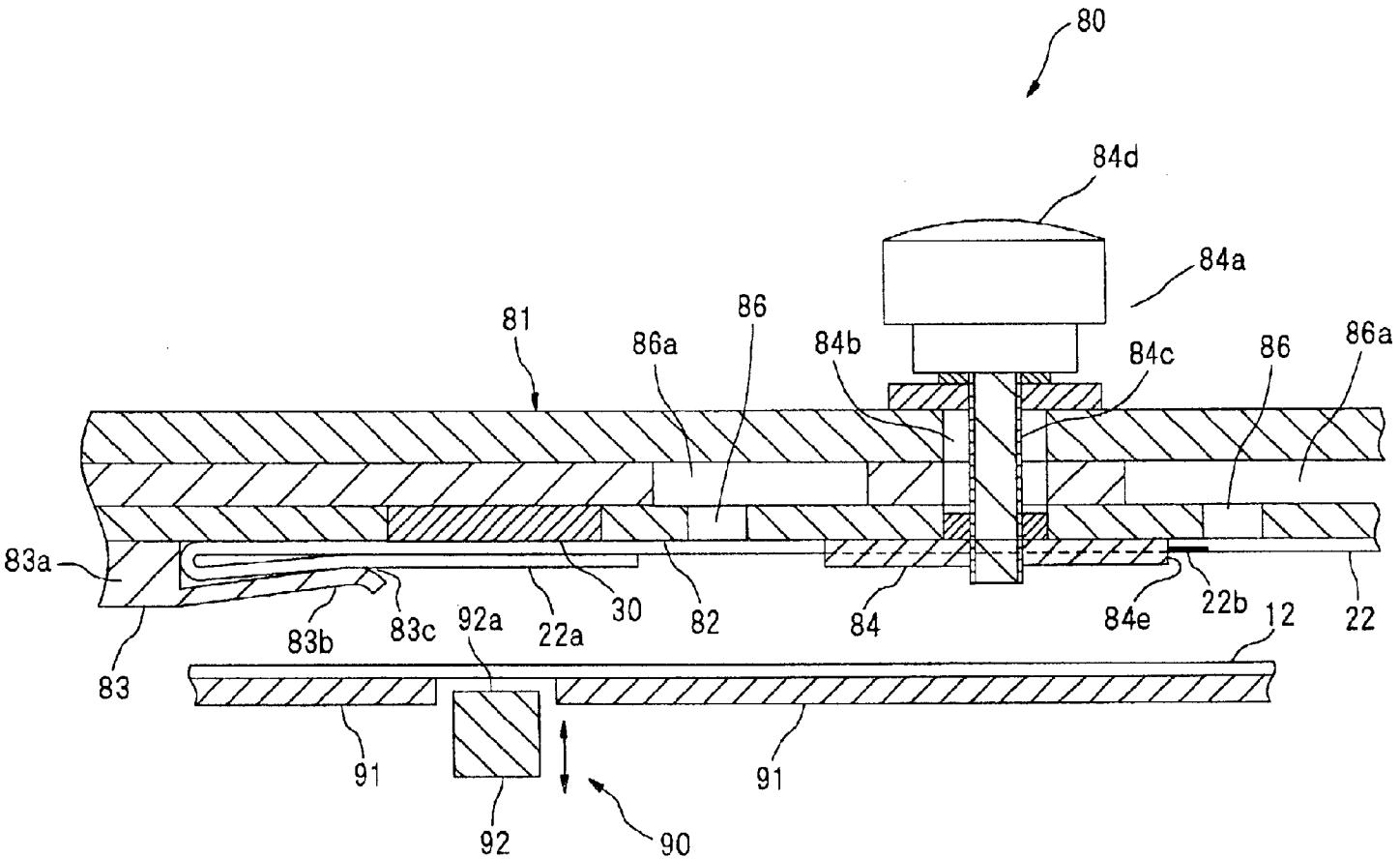
FIG. 5 is a partially enlarged side sectional view illustrating the configuration of the holding unit and the connecting unit in the film connecting/feeding apparatus of the invention.

First, in the closed state of the operating board 81, the side end edge of the film 12 delivered from the delivery position 10 and the inner end of the side end positioning member 84 are positionally aligned (see FIG. 4). In this case, since the operating board 81 is made of a transparent material, it is easy to confirm the position of the side edges of the film 12 via the operating board 81 even in the closed state.

Then, the operating board 81 is opened toward the front side of the apparatus main body 2 so that the operating surface 82 is directed upward (see FIG. 2A). The film 22 is delivered from the standby position 20, and the registration mark 22*b* affixed to the film 22 is aligned with the trailing end 84*e* of the side end positioning member 84.

Then, the film 22 is cut with reference to the slit 85 provided on the operating board 81 by use of a cutting tool such as a cutter to position the leading end 22*a* of the film 22 at the slit 85. This makes it possible to keep the leading end 22*a* of the film 22 always at a certain position relative to the registration mark 22*b*.

Figure 6:
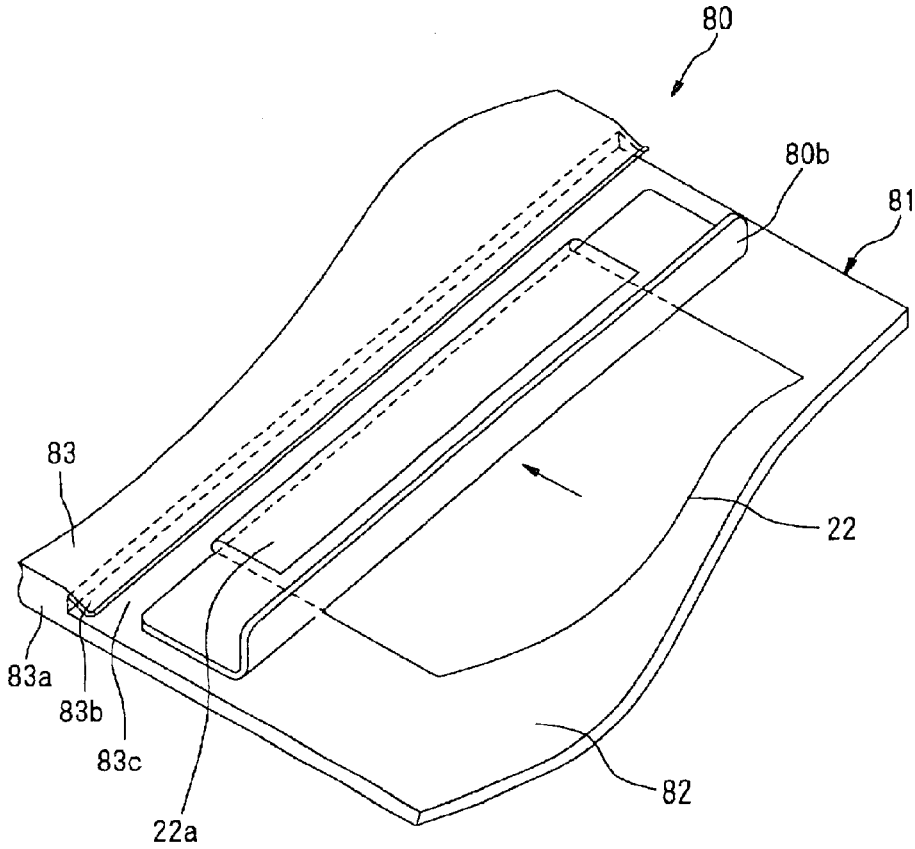
FIG. 6 is a perspective view illustrating the holding method of the film leading end by the holding unit in the film connecting/feeding apparatus of the invention.

The leading end 22*a* of the film is folded, and the folded portion is inserted through an opening 83*c* of the holding member 83 by means of an inserting jig 80*b* (see FIG. 6). By inserting the leading end 22*a* of the film 22 as described above, the folding reaction of the leading end 22*a* of the film 22 makes it possible to elastically hold in the holding member 83.

When inserting the leading end 22*a* into the holding member 83, insertion should be accomplished so that the folded portion comes into contact with the base 83*a* of the holding member 83. As a result of such insertion, it is possible to keep a constant film length from the registration mark 22*b* of the film 22 to the connecting position 30.

Since the pressing plate 83*b* of the holding member 83 is formed so as to be deflected around the base, it is possible to easily cause deflection of the pressing plate 83*b* when inserting the leading end 22*a*. It is therefore possible to easily insert the leading end 22*a* of the film 22 into the holding member 83 because the distance between the pressing plate 83*b* and the operating surface 82 of the operating board 81 becomes larger.

Then, after holding the film 22 between the film guiding pin 88 and the coil spring 89, the operating board 81 is closed (see FIG. 2A). In this closed state, the film 22 is held between the film guiding pin 88 and the coil spring 89. In addition, because the film is sucked by the suction holes 86 provided on the operating surface 82 of the operating board 81, the film 22 never sags, and the film 22 can be certainly held on the operating surface 82 (see FIG. 5).

The configuration of the connecting unit 90 will now be described in detail.

The connecting unit 90 has a guiding plate 91 and a heater block 92 and has a configuration in which a film 12 delivered from the delivery position 10 on the upper surface side of the guiding plate 91 is guided to the heater block 92.

The heater block 92 is arranged below the connecting position 30. A heating surface 92*a* is formed on the upper surface side opposite to the holding unit 80 of the heater block 92. An electric heater is built in the heater block 92, and temperature of the heating surface 92*a* can be set at a prescribed value by controlling output of the electric heater.

The heater block 92 is attached to an air cylinder not shown, and vertically movable by the driving force of the air cylinder. By moving the heater block 92 upward by driving the air cylinder, therefore, it is possible to hold the film 12 delivered from the delivery position 10 and the leading end 22*a* of the film delivered from the standby position 20 with the operating board 81 for heat sealing.

The air cylinder communicates with a compressed air source not shown via a solenoid valve. By opening and closing the solenoid valve, compressed air is supplied for driving.

[Control System of Film Connecting/Feeding Apparatus]

The control system of the film connecting/feeding apparatus will now be described with reference to FIGS.7, 8A and 8B.

Figure 7:
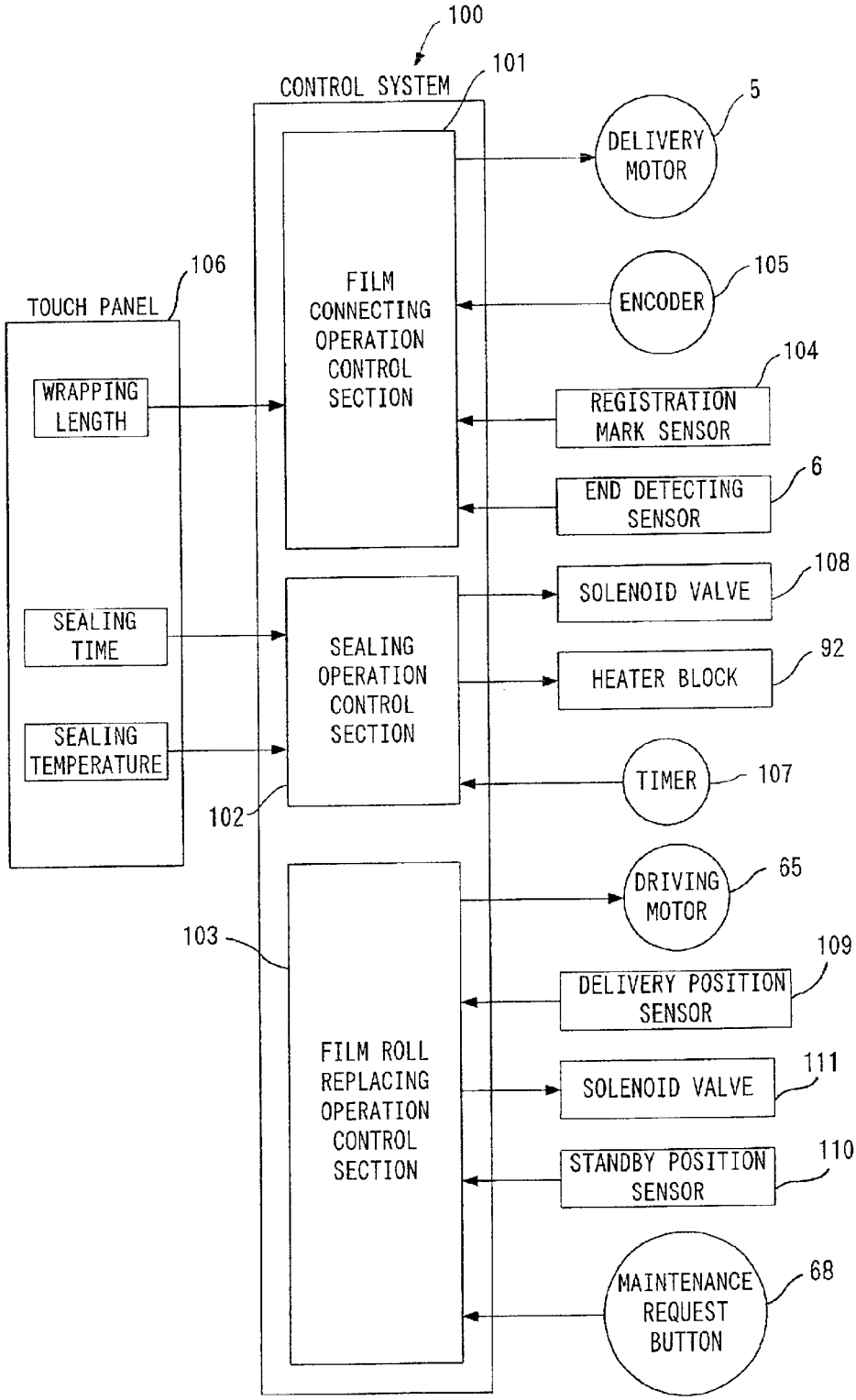
FIG. 7 is a block diagram illustrating the control system in the film connecting/feeding apparatus of the invention.
Figures 8A, 8B:
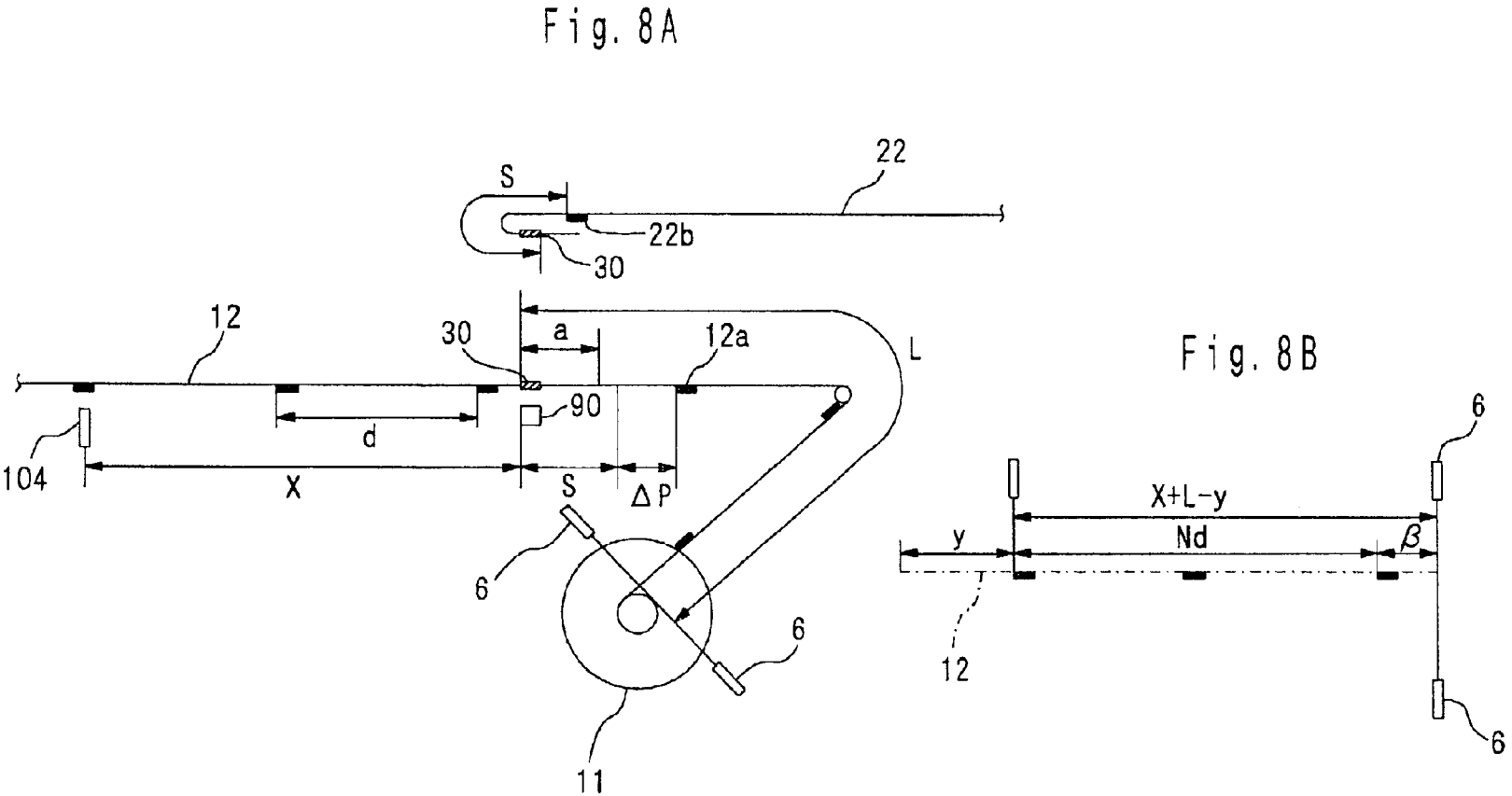
FIGS. 8A and 8B are a principle view illustrating the calculating method of the amount of film delivery in the film connecting position aligning control operation of the film connecting/feeding apparatus of the invention.
Figure 9:
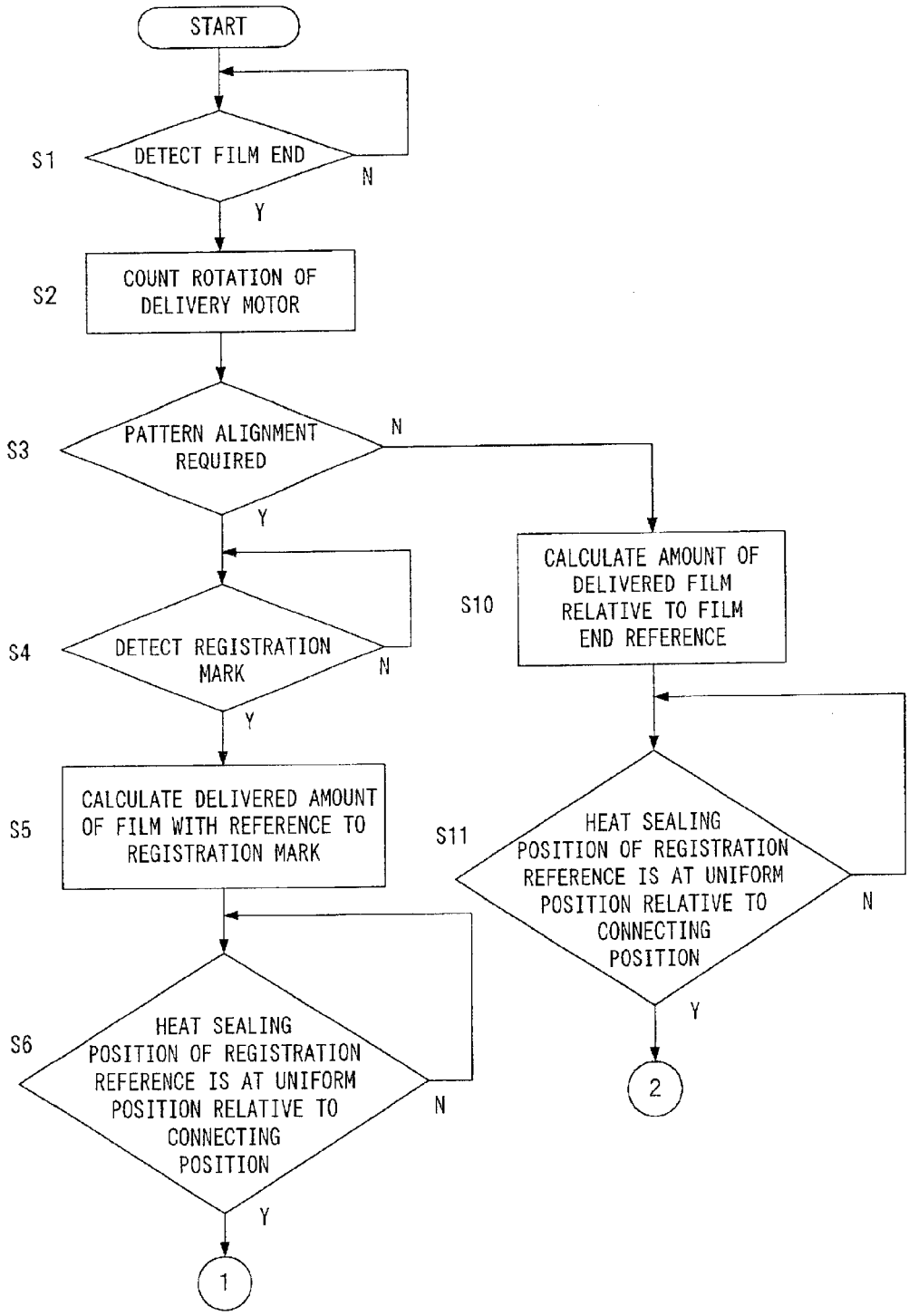
FIG. 9 is a flowchart illustrating the film connecting position aligning control operation in the film connecting/feeding apparatus of the invention.
Figure 10:
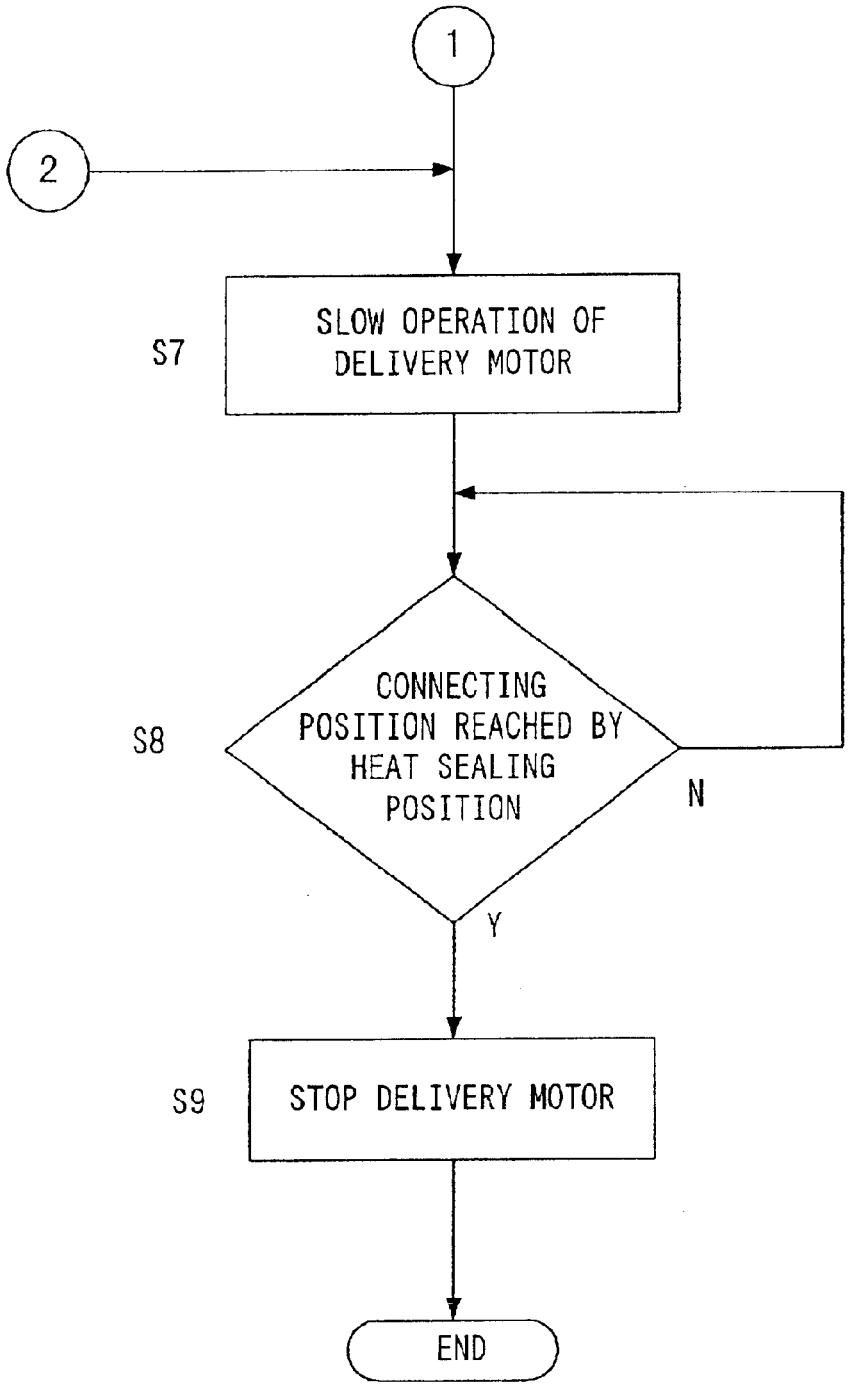
FIG. 10 is a flowchart, following that shown in FIG. 9, illustrating the film connecting position aligning control operation in the film connecting/feeding apparatus of the invention.
Figure 11:
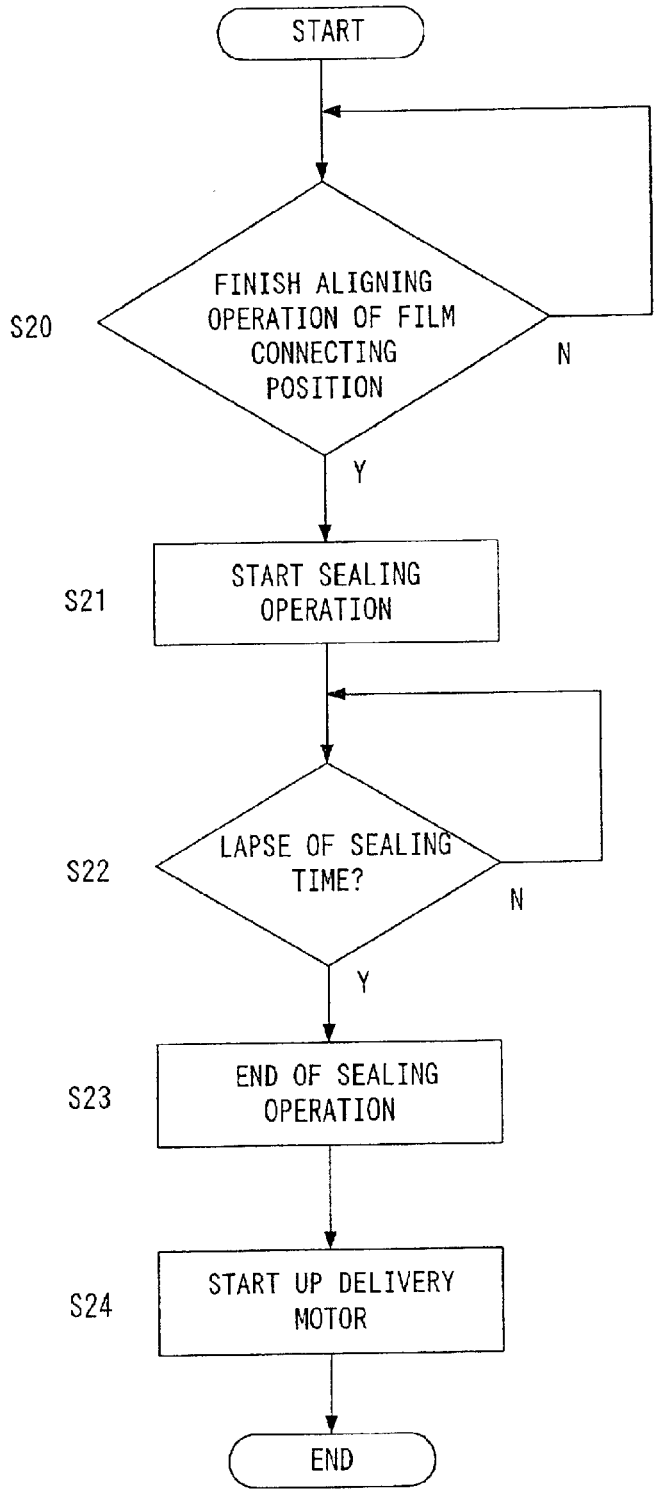
FIG. 11 is a flowchart illustrating the sealing control operation in the film connecting/feeding apparatus of the invention.
Figure 12:
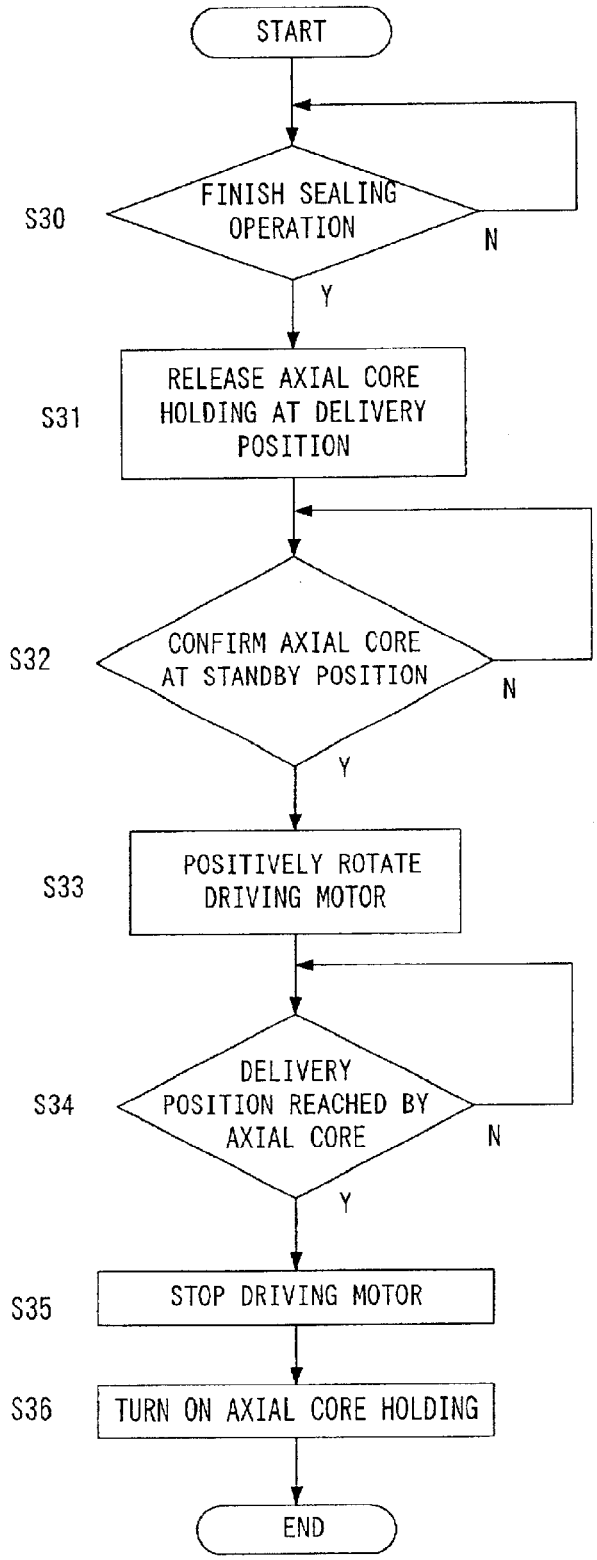
FIG. 12 is a flowchart illustrating the film roll replacing control operation in the film connecting/feeding apparatus of the invention.
Figure 13:
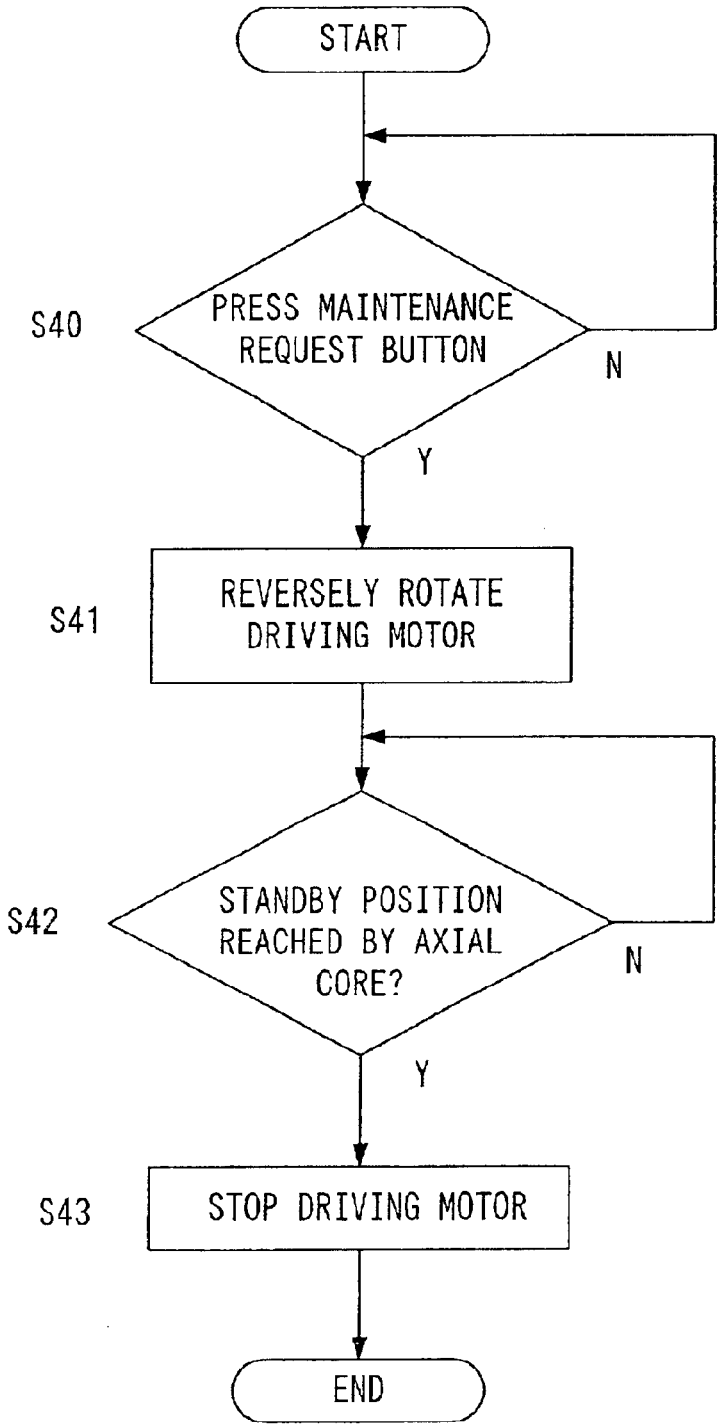
FIG. 13 is a flowchart illustrating the maintenance operation of the film connecting/feeding apparatus of the invention.

As shown in FIGS. 7, 8A and 8B, the control system 100 of the film connecting/feeding apparatus comprises a film connecting operation control section 101, a sealing operation control section 102, and a film roll replacing operation control section 103.

A terminal end detecting signal of the film 12 transmitted from a terminal end detecting sensor 6, a registration mark detecting signal to the film 12 transmitted from a registration mark sensor 104 provided on the delivery path of the film 12, and a revolutions detecting signal transmitted from an encoder 105 detecting the amount of rotation of the delivery motor 5 are entered into the film connecting operation control section 101.

The wrapping length of the film as set by a touch panel 106 is entered into the film connecting operation control section 101 which serves as storage means storing the wrapping length.

The film connecting operation control section 101 has various functions for aligning the heat sealing position set at the terminal end of the film 12 on the basis of these input data with the connecting position 30.

The film connecting operation control section 101 has a function of calculating the amount of delivery of the film 21 for aligning the heat sealing position of the film 12 with the connecting position 30 on the basis of the wrapping length d, the distance L between the terminal end detecting position and the connecting position 30 of the delivery film 12 previously set in the operation control section 101, the distance X between the registration mark sensor 104 and the connecting position 30, and the film length S from the registration mark aligning position to the connecting position 30 for the film 22.

A typical method for calculating the delivery amount will be described on the basis of the following formulae (1) to (7). First, by use of Formula (1), the number n of wrapping bags to be formed by the film included between the registration mark sensor 104 and the connecting position 30 is calculated. The difference ΔP between the position of the registration mark 12*a* of the film 12 and the registration mark aligning position upon detecting the registration mark is calculated in accordance with Formula (2), on the basis of the proposed number n of formed wrapping bags, the wrapping length d, the distance X between the registration mark sensor 104 and the connecting position 30, and the film length S between the registration mark aligning position in the film 22 and the connecting position 30.

Then, by use of Formula (3), the proposed number m of wrapping bags from the registration mark aligning position to the terminal end of the film 12 is calculated. Then, the length β from the final registration mark 12*a* to the terminal end of the film 12 is calculated on the basis of the amount of delivery y of the film 12 during a period from detection of the terminal end of the film 12 to detection of the first registration mark 12*a* and the like in accordance with Formulae (4) and (5).

For the case where there is a step of pattern aligning (with reference to registration marks), the amount of delivery P1 or P1*a* of the film 12 is calculated using the thus calculated values, in accordance with Formula (6) or (6a).

When there is no step of pattern alignment (relative to the film terminal end), the delivery amount P2 of the film 12 is calculated by use of Formula (7).

$$n=(X+S)/d(\text{counting fractions as one}) \quad (1)$$

$$\Delta P=nd-(X+S) \quad (2)$$

$$m=(L-S)/d(\text{counting fractions as zero}) \quad (3)$$

$$(X+L-y)/d=N(\text{counting fractions as zero}) \quad (4)$$

$$X+L-y-Nd=\beta \quad (5)$$

$$P1=md+\Delta P \text{ (where, } d-S+a>\beta) \quad (6)$$

$$P1a=(m+1)d+\Delta P \text{ (where, } d-S+a<\beta \text{ or } d-S+a=\beta) \quad (6a)$$

$$P2=L-a \quad (7)$$

where,

X: distance between the registration mark sensor 104 and the connecting position 30;

S: film length from registration mark aligning position in film 22 to connecting position 30;

n: proposed number of formed bags from registration mark sensor 104 to connecting position 30;

d: wrapping length;

m: proposed number of formed bags from registration mark aligning position to terminal end detecting position;

L: distance between terminal end detecting position of delivery film 12 and connecting position 30;

y: delivery amount of film 12 during period from detection of terminal end of film 12 to detection of first registration mark 12*a;*

N: proposed number of formed bags from registration mark sensor 104 to terminal end detecting position;

β: length from final registration mark 12*a* to terminal end of film;

a: constant (length from heat-sealing position of film 12 to film terminal end);

P1: delivery amount of film 12 relative to registration mark when d−S+a>β;

P1*a*: delivery amount of film 12 relative to registration mark when d−S+a<β or d−S+a=β;

P2: delivery amount of film 12 with reference to film terminal end.

A film connecting operation control section 101 a control signal of the delivery roller 4 to the delivery motor 5 on the basis of these calculated values, outputs this control signal to the delivery motor 5, and conducts connecting position aligning operation. In this connecting position aligning operation, an operating program of the delivery motor 5 is incorporated in advance in the film connecting operation control section 101 so that the delivery motor 5 operates at a low speed when heat-sealed portion of the film 12 reaches a certain position relative to the connecting position 30.

The sealing operation control section 102 has a function of performing sealing operation by issuing control signals to the solenoid valve 108 of the heater block 92 for a certain period of time, on the basis of input signals of the sealing time set by a touch panel 106 and signals transmitted from a timer 107 counting this sealing period.

The sealing operation control section 102 has a function of setting a certain temperature for the heating surface 92*a* of the heater block 92 by issuing control signals to the electric heater of the heater block 92, on the basis of input signals of the sealing temperature set on the touch panel 106.

A detecting signal of the axial core 11*a* of the film roll 11 transmitted from the delivery position sensor 109 provided near the delivery position 10, a detecting signal of the axial core 21*a* of the film roll 21 transmitted from the standby position sensor 110 provided near the standby position 20, and a signal issued by pressing the maintenance request button 68 are entered into the film roll replacing operation control section 103.

The film roll replacing operation control section 103 has a function of generating control signals to the driving motor 65 of the driving-side sprocket 61 on the basis of these input signals, issuing these control signals to the driving motor 65, and performing film replacing operation and the like.

The film roll replacing operation control section 103 has a function of issuing control signals to the solenoid valve 111 driving the air cylinder 42 of the delivery supporting unit 40 provided at the delivery position 10.

Then, the individual control operations by the control system 100 of the film connecting/feeding apparatus will be described with reference to FIGS. 9 to 16.

Upon confirmation of detection of the terminal end position of the film 12 on the basis of the signal from the terminal end detecting sensor 6 (S1), the film connecting operation control section 101 starts counting of the amount of rotation of the delivery motor 5, on the basis of a signal from the encoder 105 (S2).

Then, when conducting pattern alignment with reference to the position of the registration mark 12*a* affixed to the film 12 (S3), upon confirmation of detection of the registration mark 12*a* of the film 12 on the basis of a signal from the registration mark sensor 104, the film connecting operation control section 101 calculates the delivery amount of the film 12 relative to the registration mark 2*a* (S5), upon confirmation of detection of the registration mark 12*a* of the film 12 (S4).

Upon confirming that the heat-sealed position reaches a certain position relative to the connecting position 30 with reference to the registration mark (S6), the film connecting operation control section 101 issues an operating instruction to the delivery motor 5 to switch over the rotational speed of the delivery motor 5 to a low speed (S7).

Then, upon confirming that the heat-sealed position reaches the connecting position 30 (S8) on the basis of a signal from the encoder 105, the film connecting operation control section 101 issues a stop instruction to the delivery motor 5 to stop the delivery motor 5 (S9), thus completing the film connecting positioning operation relative to the registration mark.

When carrying out film connection positioning operation with reference to the terminal end of the film 12, the film connecting operation control section 101 calculates the delivery amount of the film 12 with reference to the film terminal end (S10).

Upon confirming that the heat-sealed position based on the film terminal end reaches a certain position relative to the connecting position 30 (S11), the film connecting operation control section 101 issues an operating instruction to the delivery motor 5 to switch over the rotation speed of the delivery motor 5 to a low speed (S7), and continues to perform similarly the film connection positioning operations.

Then, upon confirming that the film connection positioning operation by the film connecting operation control section 101 (S20), the sealing operation control section 102 issues an operating instruction to the solenoid valve 108 of the heater block 92 to open the solenoid value 108, moves the heater block 92 upward, and performs sealing operation (S21).

Then, upon confirming that a set sealing time has elapsed on the basis of a signal from the timer 107 (S22), the sealing operation control section 102 issues an operating instruction to the solenoid valve 108 to close the solenoid valve 108, moves the heater block 92 downward, and completes the sealing operations (S23).

The sealing operation control section 102 issues an operating instruction to the delivery motor 5 to start up the delivery motor 5 (S24), and resumes delivery of the film 12 by means of the delivery roller 4.

The folded portion formed by folding the leading end 22*a* of the film 22 is elastically held in the holding member 83 in this embodiment. When delivering after film connection, therefore, the leading end 22*a* of the film 22 easily comes off the holding member 83, thus permitting prevention of occurrence of a positional shift of the connected films.

Then, upon confirming that the sealing operation by the sealing operation control section 102 is completed (S30), the film roll replacing operation control section 103 issues an operating instruction to the solenoid valve 111 of the air cylinder 42 provided in the delivery supporting unit 40 to close the solenoid valve 111, moves upward the air cylinder 42, i.e., the upper bearings 41*c* and 41*d*, and releases the holding state of the axial core after delivery of the film by the bearings 41*a* to 41*d* of the delivery supporting unit 40 (S31).

Then, upon confirming that there is an axial core 21*a* of the spare film roll 21 at the standby position 20 on the basis of a signal from the standby position sensor 110 (S32), the film roll replacing operation control section 103 issues an operating instruction to the driving motor 65 of the driving-side sprocket 61 to drive the driving motor 65 counterclockwise in the drawing (S33), moves the conveying member 66 from the delivery position 10, and conveys the axial core 11*a* having delivered the film to the discharge unit 70.

Figure 14:
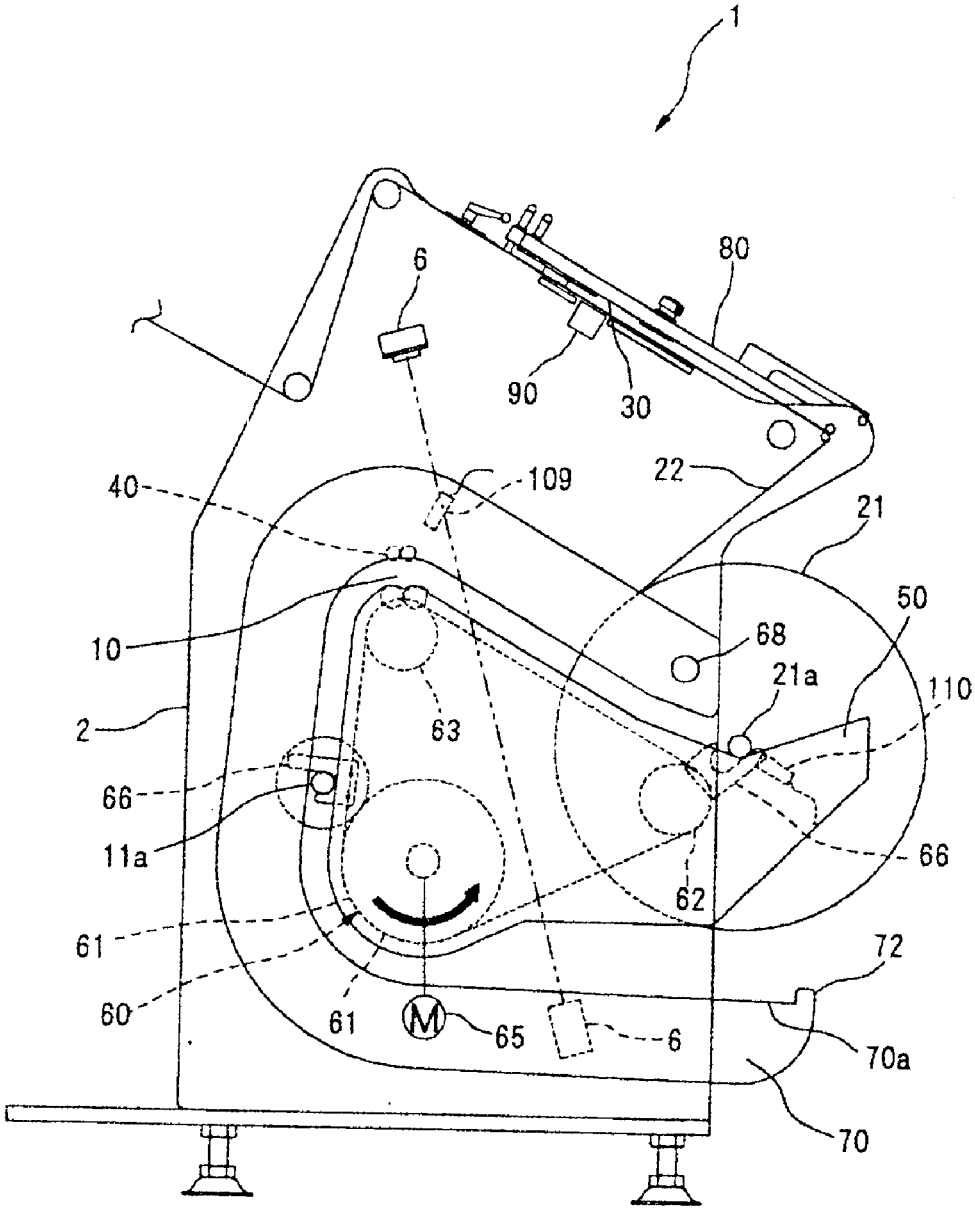
FIG. 14 is a side view of the film connecting/feeding apparatus for illustrating the film replacing operation in the film connecting/feeding apparatus of the invention.

The conveying member 66 present on the 180E-opposite side receives the axial core 21*a* of the spare film roll 21 from the standby position 20, and conveys this film roll 21 to the delivery position 10 (see FIG. 14).

Figure 15:
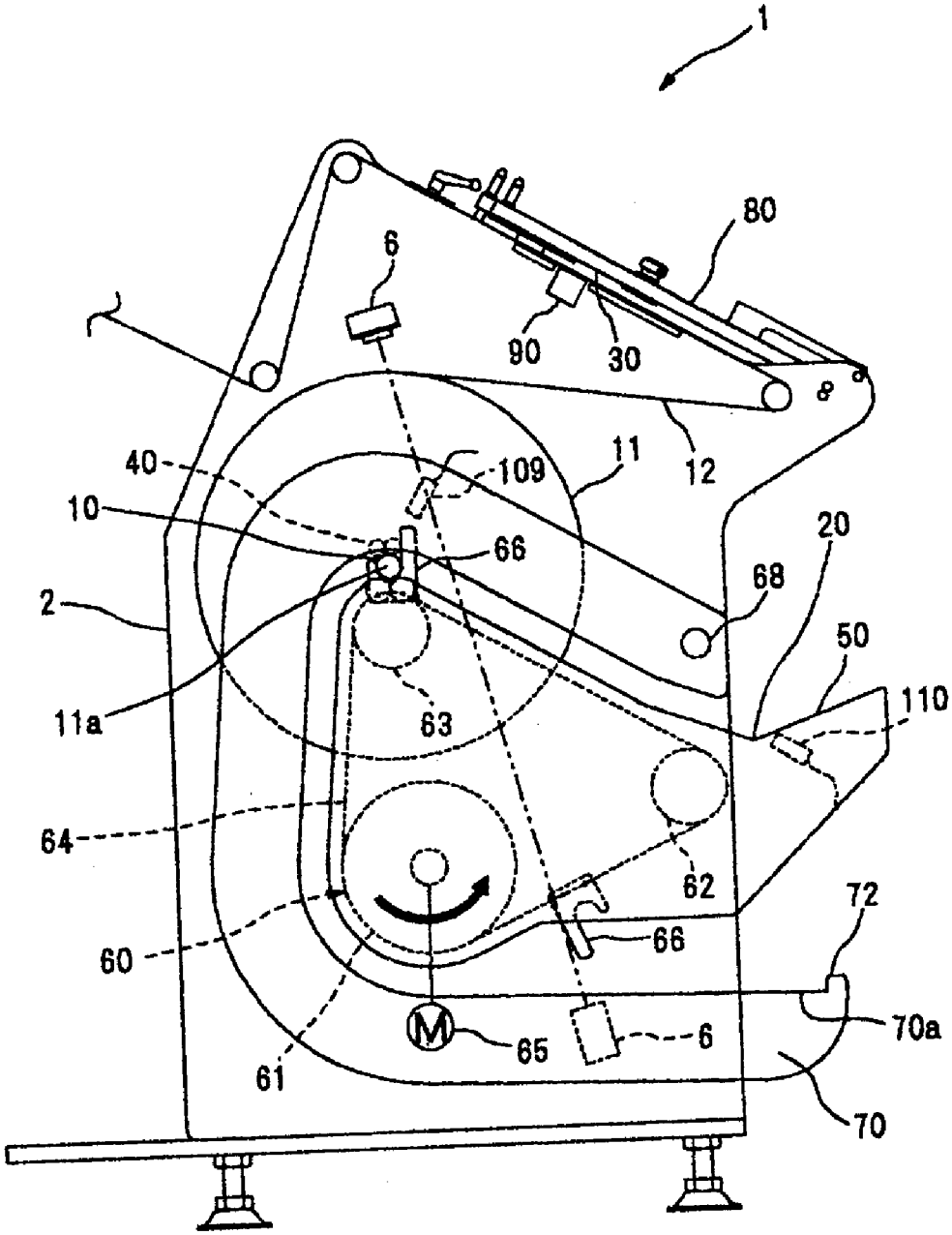
FIG. 15 is a side view of the film connecting/feeding apparatus following that shown in FIG. 14 for illustrating the film replacing operation in the film connecting/feeding apparatus of the invention.

Then, upon confirming that the axial core 21*a* of the spare film roll 21 reaches the delivery position 10 from a signal from the delivery position sensor 109 (S34), the film roll replacing operation control section 103 issues a stop signal to the driving motor 65 to stop the driving motor 65 (S35; FIG. 15).

The film roll replacing operation control section 103 issues an operating instruction to the solenoid valve 111 of the delivery supporting unit 40 to release the solenoid valve 111, and moves the upper bearings 41*c* and 41*d* downward to hold the axial core 21*a* of the film roll 21 between the upper and lower bearings 41*a* to 41*d* (S36), thus completing the film roll replacing operation.

Upon confirming that the maintenance request button 68 provided on the apparatus main body 2 of the film connecting/feeding apparatus 1 is pressed down (S40), the film roll replacing operation control section 103 issues an operating instruction to the driving motor 65 of the driving-side sprocket 61 while the maintenance request button 68 is pressed down, to cause clockwise rotation of the driving motor 65 (S41), and conveys the film roll 111 at the delivery position 10 to the standby position 20.

Figure 16:
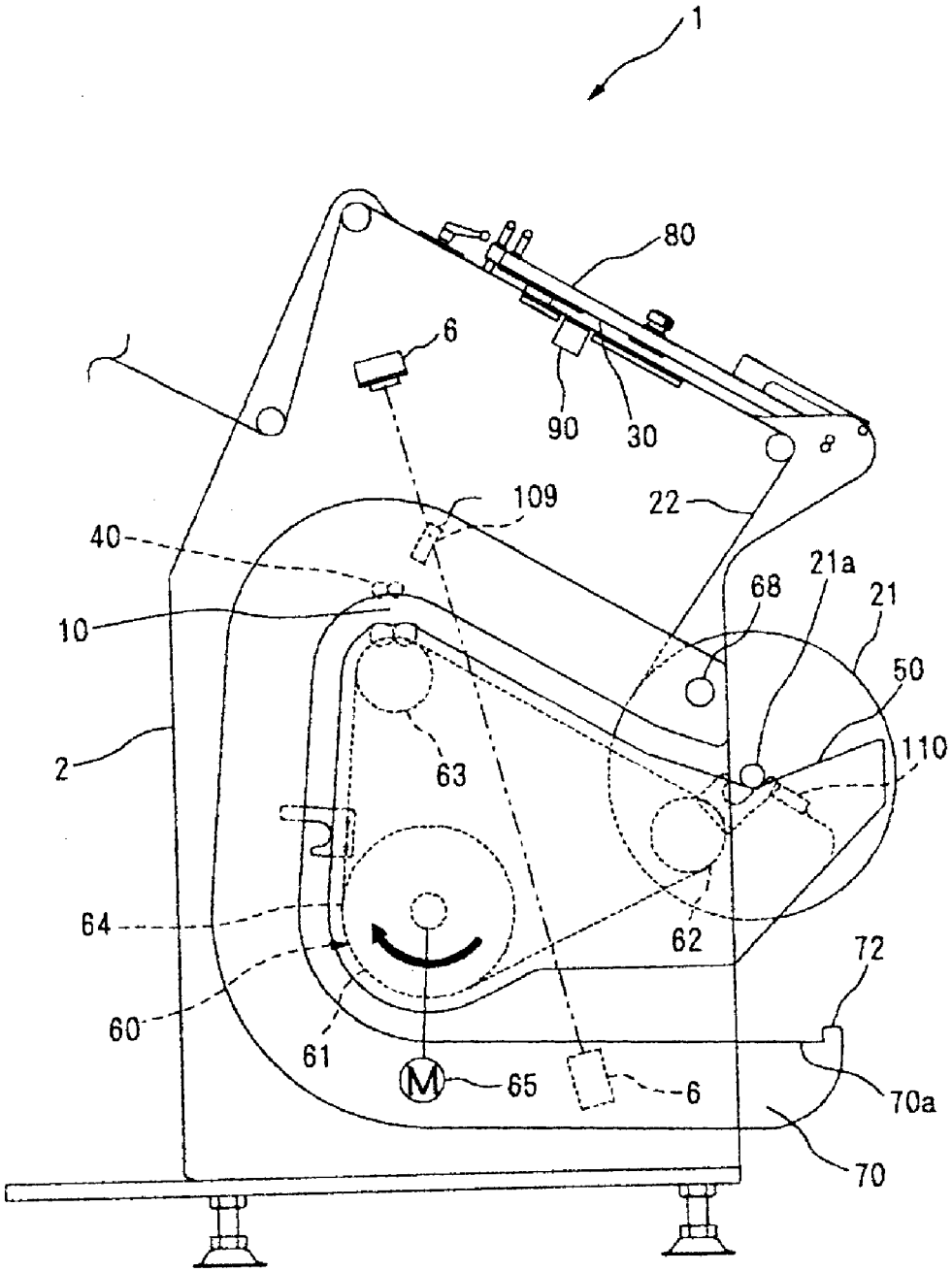
FIG. 16 is a side view for illustrating the maintenance operation of the film connecting/feeding apparatus of the invention.
Figure 17:
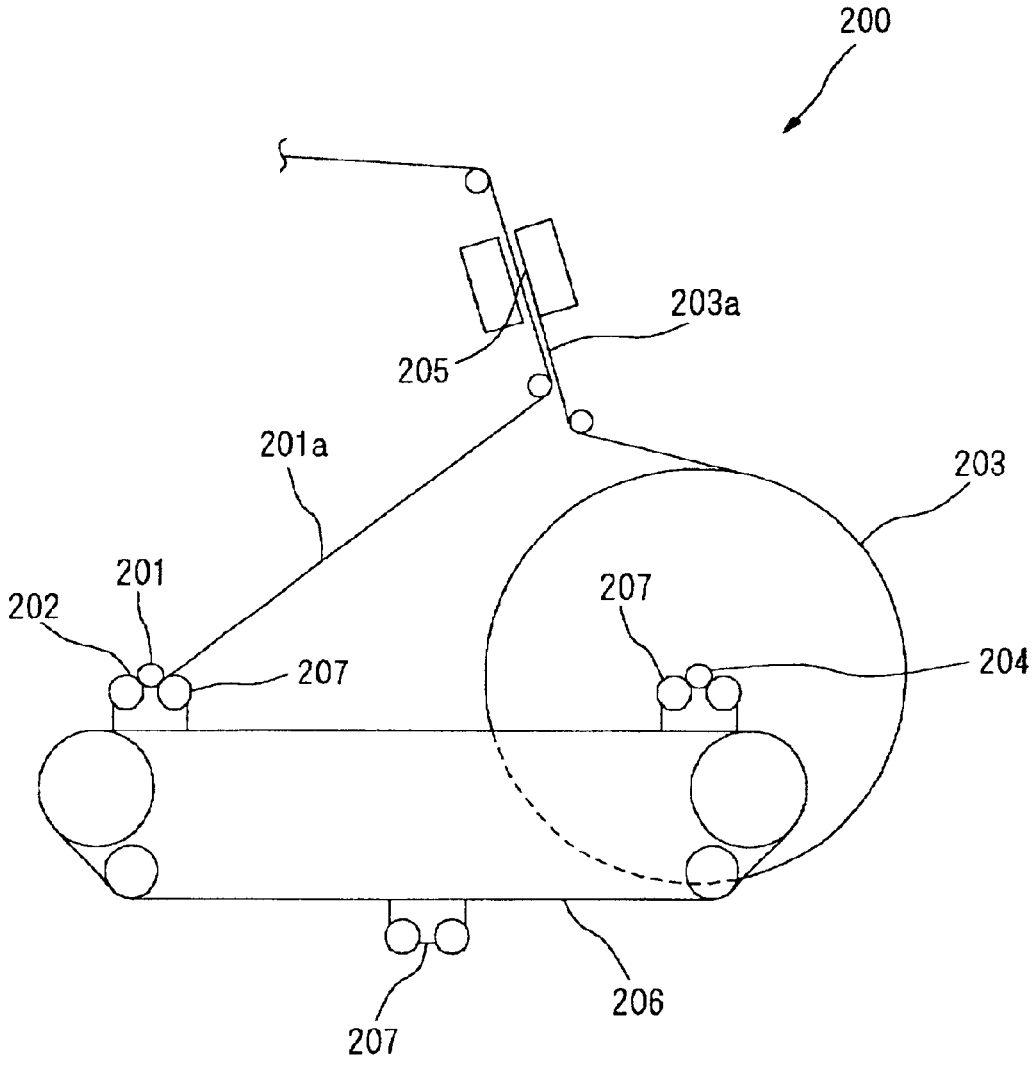
FIG. 17 is a side view illustrating the configuration of a conventional film connecting/feeding apparatus.
Figure 18:
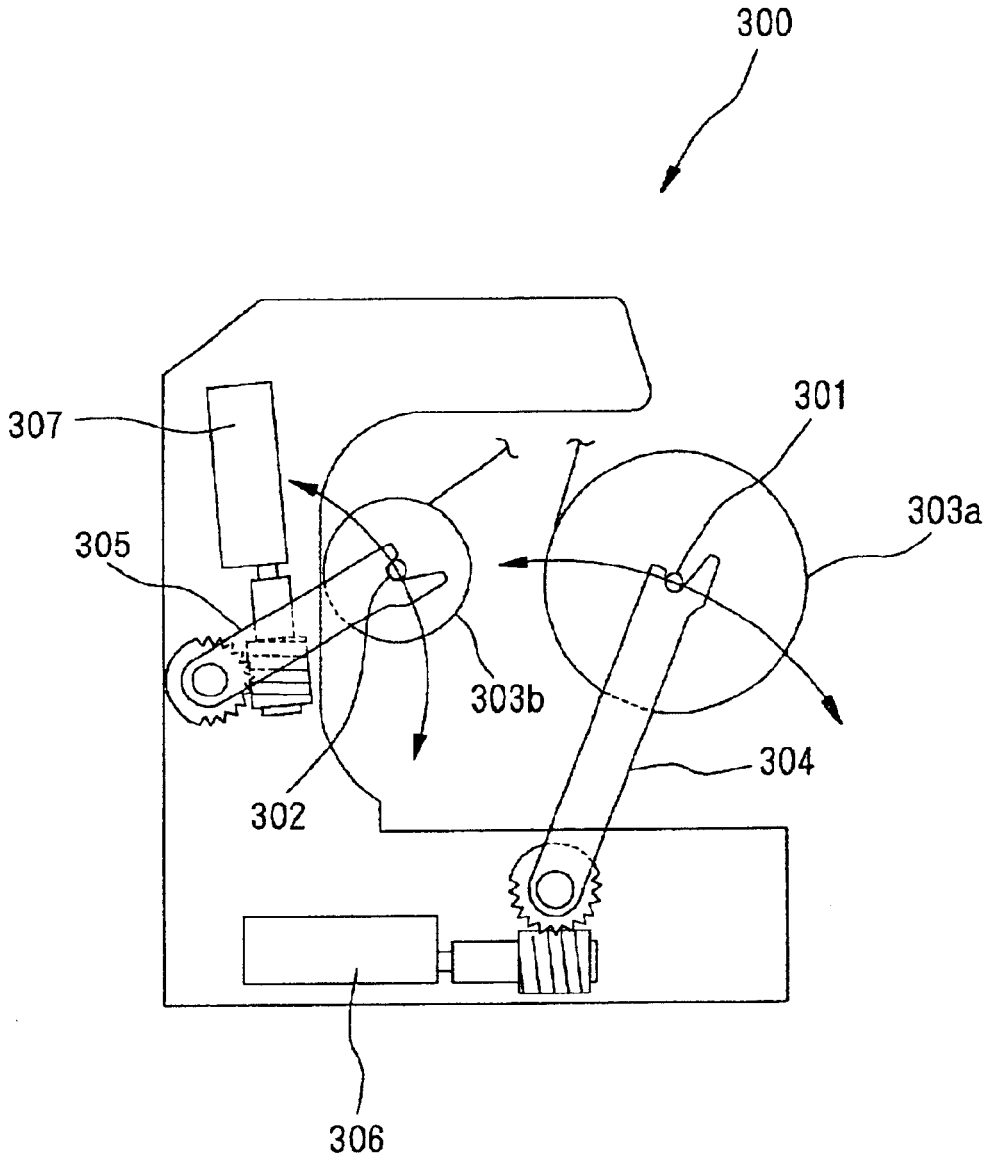
FIG. 18 is a side view illustrating the configuration of another conventional film connecting/feeding apparatus.

Upon confirming that the axial core 11*a* of the film roll 11 reaches the standby position on the basis of a signal from the standby position sensor 110 (S42), the film roll replacing operation control section 103 issues a stop instruction to the driving motor to stop the driving motor 65 (S43; see FIG. 16).

According to the present invention, as described above, there are provided delivery supporting means and standby supporting means supporting the film roll at the delivery position and the standby position, respectively. It is not therefore necessary to impart a function for supporting the film roll to the roll conveying means accounting for an important weight in the apparatus parts cost. It is therefore possible to simplify configuration of the roll conveying means, thus permitting reduction of the manufacturing cost for the apparatus as a whole.

Furthermore, the roll conveying means comprises an endless belt member put around a rotary member and a conveying member is attached to this endless belt member. It is therefore possible to cause rotation of the rotary member with a single driving source and to achieve circumferential travel of the conveying member under the effect of the rotational driving force thereof. It is not therefore necessary to provide a plurality of driving sources, thus reducing the number of driving sources and permitting reduction of the apparatus cost also in this respect.

In addition, the folded portion formed by folding the leading end of the film delivered from the standby position is held by inserting into the holding member. Upon delivery after film connection, therefore, the leading end of the film easily comes off the holding member, thus preventing occurrence of a positional shift of the film.

What is claimed is:

1. A film connecting/feeding apparatus defining a delivery position where a delivery film roll is held; a standby position where a spare film roll is held; and a connecting position where a leading end of a film delivered from said spare film roll is held and said leading end and a film delivered from said delivery position are connected; comprising:

delivery supporting means arranged at said delivery position for rotatably supporting an axial core of a delivery film roll, standby supporting means arranged at said standby position for supporting an axial core of the spare film roll, said standby supporting means being separate from said delivery supporting means;

a rotary member;

an endless belt member arranged to run around said rotary member, and roll conveying means for holding the axial core of the film roll, said roll conveying means comprising a conveying member attached to said endless belt member, wherein said roll conveying member is arranged to receive a spare film roll from said standby supporting means, remove said spare film roll from said standby supporting means, convey said spare film roll to said delivery position, and pass said spare film roll to said delivery supporting means at said delivery position upon movement of said endless belt member.

2. A film connecting/feeding apparatus according to claim 1, further comprising:

a discharge path for discharging the axial core after having delivered the film; wherein the conveying member of said roll conveying means further receives an axial core after having delivered the film, from said delivery supporting means and conveys the axial core to said discharge path.

3. A film connecting/feeding apparatus according to claim 1, further comprising:

a main body;

an operating board attached to said main body so as to be opened and closed;

a holding member which holds an inserted folded portion formed by folding the leading end of the film delivered from said standby position, with a side of said operating board as an operating surface is attached to said operating surface; and in the closed state of said operating board, said holding member is positioned at said connecting position.

4. A film connecting/feeding apparatus according to claim 3, wherein an operating position for carrying out an operation of folding the leading end of the film delivered from said standby position and causing the holding member to hold the folded position is defined on a front side of said main body; and said operating board is arranged so that, in the opened state, said operating surface is placed upward at said operating position.

5. A film connecting/feeding apparatus according to claim 4, further comprising a discharge path for discharging the axial core after having delivered the film, wherein a feeding position at which the film roll is fed to said standby position, a discharge position defined at a terminal end of said discharge path, and said operating position are arranged in the height direction on the front side of said main body.

6. A film connecting/feeding apparatus according to claim 3, wherein an edge positioning section which guides edges on both sides of the film delivered from said standby position is formed on said operating surface of said operating board.

7. A film connecting/feeding apparatus according to claim 3, wherein said operating board is made of a transparent material.

8. A film connecting/feeding apparatus according to claim 1, further comprising:

end detecting means for detecting an end of the film delivered from said delivery position at a prescribed detecting position; and connecting position aligning means for delivering an end portion of the film of which the end has been detected by said end detecting means to said connecting position based on a distance between said detecting position and said connecting position.

9. A film connecting/feeding apparatus according to claim 8, further comprising:

registration mark detecting means for detecting a registration mark attached to the film delivered from said delivery position at a prescribed position;

wrapping length storing means for storing a wrapping length set on the film delivered from said delivery position; and registration mark aligning means for aligning a registration mark position of a film of which the end has been detected by said end detecting means and of which the registration mark has been detected by said registration mark detecting means with the registration mark position of a film of which the leading end portion has been held at said connecting position, on the basis of a wrapping length stored in said wrapping length storing means and a distance between said registration mark detecting position and the connecting position.

10. A film connecting/feeding apparatus according to claim 1, wherein said delivery supporting means comprise a plurality of bearings arranged to support the axial core of the delivery film roll, said conveying means being arranged to transfer the axial core of the spare film roll from said conveying member onto said bearings.

11. A film connecting/feeding apparatus according to claim 10, wherein said conveying member is arranged relative to said bearings such that after said conveying member transfers the axial core of the spare film roll onto said bearings, said conveying member is held in a standby position at said delivery position in which said conveying member is not in contact with said axial core.

12. A film connecting/feeding apparatus according to claim 1, further comprising a main body, said delivery supporting means comprising a plurality of bearings connected to said main body and said standby supporting means comprising a pair of feeding rails extending on a front side of said main body.

13. A film connecting/feeding apparatus defining a delivery position where a delivery film roll is held, a standby position where a spare film roll is held and a connecting position where a leading end of a film delivered from the spare film roll is held and the leading end and a film delivered from the delivery position are connected; comprising:

delivery supporting means arranged at the delivery position for rotatably supporting an axial core of the delivery film roll;

standby supporting means arranged at the standby position for supporting an axial core of the spare film roll;

a rotary member;

an endless belt member arranged to run around said rotary member;

roll conveying means for holding the axial core of the film roll said roll conveying means comprising a conveying member attached to said endless belt member and arranged to receive a spare film roll from said standby supporting means, convey said spare film roll to the delivery position, and pass said spare film roll to said delivery supporting means;

a main body;

an operating board attached to said main body so as to be opened and closed; and a holding member which holds an inserted folded portion formed by folding the leading end of the film delivered from said standby position, with a side of said operating board as an operating surface being attached to said operating surface, and in the closed state of said operating board, said holding member being positioned at said connecting position.

14. A film connecting/feeding apparatus according to claim 13, wherein an operating position for carrying out an operation of folding the leading end of the film delivered from the standby position and causing the holding member to hold the folded position is defined on a front side of said main body; and said operating board is arranged so that, in the opened state, said operating surface is placed upward at said operating position.

15. A film connecting/feeding apparatus according to claim 14, further comprising a discharge path for discharging the axial core after having delivered the film, wherein a feeding position at which the film roll is fed to the standby position, a discharge position defined at a terminal end of said discharge path, and said operating position are arranged in the height direction on the front side of said main body.

16. A film connecting/feeding apparatus according to claim 13, wherein an edge positioning section which guides edges on both sides of the film delivered from the standby position is formed on said operating surface of said operating board.

17. A film connecting/feeding apparatus according to claim 13, wherein said operating board is made of a transparent material.

18. A film connecting/feeding apparatus including delivery position where a delivery film roll is held, a standby position where a spare film roll is held and a connecting position where a leading end of a film delivered from the spare film roll is held and the leading end and a film delivered from the delivery position are connected; comprising:

delivery supporting means arranged at the delivery position for rotatably supporting an axial core of the delivery film roll;

standby supporting means arranged at the standby position for supporting an axial core of the spare film roll;

a rotary member;

an endless belt member arranged to run around said rotary member;

roll conveying means for holding the axial core of the film roll, said roll conveying means comprising a conveying member attached to said endless belt member and arranged to receive the spare film roll from said standby supporting means, convey the spare film roll to the delivery position, and pass the spare film roll to said delivery supporting means;

end detecting means for detecting an end of the film delivered from the delivery position at a prescribed detecting position; and connecting position aligning means for delivering an end portion of the film of which the end has been detected by said end detecting means to the connecting position based on a distance between the detecting position and the connecting position.

19. A film connecting/feeding apparatus according to claim 18, further comprising:

registration mark detecting means for detecting a registration mark attached to the film delivered from the delivery position at a prescribed position;

wrapping length storing means for storing a wrapping length set on the film delivered from the delivery position; and registration mark aligning means for aligning a registration mark position of a film of which the end has been detected by said end detecting means and of which the registration mark has been detected by said registration mark detecting means with the registration mark position of a film of which the leading end portion has been held at the connecting position, on the basis of a wrapping length stored in said wrapping length storing means and a distance between said registration mark detecting position and the connecting position.

* * * * *